US012209299B2

(12) United States Patent
Ono et al.

(10) Patent No.: US 12,209,299 B2
(45) Date of Patent: Jan. 28, 2025

(54) STEEL SHEET AND METHOD FOR PRODUCING THE SAME

(71) Applicant: JFE Steel Corporation, Tokyo (JP)

(72) Inventors: Yoshihiko Ono, Tokyo (JP); Yasushi Kitani, Tokyo (JP); Hiroyuki Akimoto, Tokyo (JP); Yoichiro Matsui, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 676 days.

(21) Appl. No.: 17/442,744

(22) PCT Filed: Mar. 26, 2020

(86) PCT No.: PCT/JP2020/013800
§ 371 (c)(1),
(2) Date: Sep. 24, 2021

(87) PCT Pub. No.: WO2020/203687
PCT Pub. Date: Oct. 8, 2020

(65) Prior Publication Data

US 2022/0235442 A1 Jul. 28, 2022

(30) Foreign Application Priority Data

Mar. 29, 2019 (JP) ..... 2019-065204

(51) Int. Cl.
*C22C 38/00* (2006.01)
*C21D 1/25* (2006.01)
(Continued)

(52) U.S. Cl.
CPC ..... *C22C 38/004* (2013.01); *C21D 1/25* (2013.01); *C21D 1/76* (2013.01); *C21D 8/0226* (2013.01);
(Continued)

(58) Field of Classification Search
None
See application file for complete search history.

(56) References Cited

U.S. PATENT DOCUMENTS 9,074,272 B2 7/2015 Akamizu et al.
10,876,181 B2 12/2020 Takeda et al.
(Continued)

FOREIGN PATENT DOCUMENTS

CN 102712978 A 10/2012
EP 2527484 A1 11/2012
(Continued)

OTHER PUBLICATIONS

Wan, F. et al., "Modeling of Strip Healing Process in Vertical Continuous Annealing Furnace", Journal of Iron and Steel Research, Intl., Dec. 31, 2012, vol. 19(5), pp. 29-36, XP093033209, Retrieved from the Internet: https://www.sciencedirect.com/science/article/pii/S1006706X1260096X/pdf?md5=5084477b2f7b90c23a59e56c81f64&pid=1-s2.0-S1006706X1260096X-main.pdf [retrieved on Mar. 20, 2023].
(Continued)

*Primary Examiner* — Xiaowei Su
(74) *Attorney, Agent, or Firm* — Buchanan Ingersoll & Rooney PC

(57) ABSTRACT

The steel sheet has a steel microstructure containing ferrite: 6% to 90% by area, a microstructure composed of one or more of upper bainite, fresh martensite, tempered martensite, lower bainite, and retained γ: 10% to 94% by area in total, and retained γ: 3% to 20% by volume, a ratio ($S_{UB}/S_{2nd}$)×100(%) of an area ratio $S_{UB}$ of an upper bainite with a width in the range of 0.8 to 7 μm, a length in the range of 2 to 15 μm, and an aspect ratio of 2.2 or more in contact with retained $\gamma_{UB}$ with a grain width in the range of 0.17 to 0.80 μm and an aspect ratio in the range of 4 to 25 to an area ratio $S_{2nd}$ of the microstructure composed of one or more of upper
(Continued)

a; UPPER BAINITE (WITH LITTLE CARBIDE)
b; RETAINED $\gamma_{UB}$ FORMED ADJACENT TO UPPER BAINITE (RETAINED γ WITH A GRAIN WIDTH OF 0.17-0.80 μm AND AN ASPECT RATIO OF 4-25)
c; TEMPERED MARTENSITE
d; LOWER BAINITE
e; FRESH MARTENSITE
f; POLYGONAL FERRITE bainite, fresh martensite, tempered martensite, lower bainite, and retained γ ranges from 2.0% to 15%.

24 Claims, 2 Drawing Sheets

(51) Int. Cl.

| | |
|---|---|
| ***C21D 1/76*** | (2006.01) |
| ***C21D 8/02*** | (2006.01) |
| ***C21D 8/04*** | (2006.01) |
| ***C21D 9/48*** | (2006.01) |
| ***C22C 38/02*** | (2006.01) |
| ***C22C 38/04*** | (2006.01) |
| ***C22C 38/06*** | (2006.01) |
| ***C22C 38/12*** | (2006.01) |
| ***C22C 38/14*** | (2006.01) |
| ***C22C 38/34*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/58*** | (2006.01) |
| ***C22C 38/60*** | (2006.01) |
| ***C23C 2/28*** | (2006.01) |

(52) U.S. Cl.

CPC ..... *C21D 8/0236* (2013.01); *C21D 8/0273* (2013.01); *C21D 8/0436* (2013.01); *C21D 9/48* (2013.01); *C22C 38/001* (2013.01); *C22C 38/002* (2013.01); *C22C 38/02* (2013.01); *C22C 38/04* (2013.01); *C22C 38/06* (2013.01); *C22C 38/12* (2013.01); *C22C 38/14* (2013.01); *C22C 38/34* (2013.01); *C22C 38/42* (2013.01); *C22C 38/44* (2013.01); *C22C 38/46* (2013.01); *C22C 38/48* (2013.01); *C22C 38/58* (2013.01); *C22C 38/60* (2013.01); *C23C 2/28* (2013.01); *C23C 2/29* (2022.08); *C21D 2211/001* (2013.01); *C21D 2211/002* (2013.01); *C21D 2211/005* (2013.01); *C21D 2211/008* (2013.01)

(56) References Cited

U.S. PATENT DOCUMENTS

| | | | | |
|---|---|---|---|---|
| 11,390,930 | B2 * | 7/2022 | Ono ..... | C21D 6/005 |
| 2011/0008647 | A1 | 1/2011 | Azuma et al. | |
| 2019/0360081 | A1 | 11/2019 | Minami et al. | |
| 2020/0157647 | A1 | 5/2020 | Ono et al. | |

FOREIGN PATENT DOCUMENTS

| | | | |
|---|---|---|---|
| EP | 3438309 | A1 | 2/2019 |
| JP | 0635619 | B2 | 5/1994 |
| JP | 3854506 | B2 | 12/2006 |
| JP | 3881559 | B2 | 2/2007 |
| JP | 4411221 | B2 | 2/2010 |
| JP | 4716359 | B2 | 7/2011 |
| JP | 6439903 | B1 | 12/2018 |
| WO | 2016136810 | A1 | 9/2016 |
| WO | 2018151023 | A1 | 8/2018 |
| WO | 2018190416 | A1 | 10/2018 |

OTHER PUBLICATIONS

European Communication for European Application No. 20 784 431.7, dated Mar. 30, 2023.

International Search Report and Written Opinion for International Application No. PCT/JP2020/013800, dated Jun. 23, 2020, 5 pages.

Korean Office Action for Korean Application No. 10-2021-7030797, dated Mar. 13, 2023 with Concise Statement of Relevance of Office Action, 7 pages.

Sahay et al., "Annealing of Steel", ASM Handbook, vol. 4A, Steel Heat Treating Fundamentals and Processes, 2013, 16 pages.

"Typical Atmosphere Types and Composition", 2010, retrieved from the internet at https://www.industrialheating.com/ext/resources/IH/Home/Images/ih0910-htdr-table 1-lg. jpg, 1 page.

Extended European Search Report for European Application No. 20784431.7, dated Feb. 28, 2002, 12 pages.

Chinese Office Action for Chinese Application No. 202080024663.0, dated Jan. 30, 2022 with Concise Statement of Relevance of Office Action, 9 pages.

* cited by examiner a; UPPER BAINITE (WITH LITTLE CARBIDE)
b; RETAINED $\gamma_{UB}$ FORMED ADJACENT TO UPPER BAINITE (RETAINED $\gamma$ WITH A GRAIN WIDTH OF 0.17-0.80 μm AND AN ASPECT RATIO OF 4-25)
c; TEMPERED MARTENSITE
d; LOWER BAINITE
e; FRESH MARTENSITE
f; POLYGONAL FERRITE

STEEL SHEET AND METHOD FOR PRODUCING THE SAME

CROSS REFERENCE TO RELATED APPLICATIONS

This is the U.S. National Phase application of PCT/JP2020/013800, filed Mar. 26, 2020 which claims priority to Japanese Patent Application No. 2019-065204, filed Mar. 29, 2019, the disclosures of these applications being incorporated herein by reference in their entireties for all purposes.

FIELD OF THE INVENTION

The present invention relates to a steel sheet which can be suitably applied to press forming and be used through a press forming process for automobiles, household electrical appliances and the like, and a method for producing the steel sheet.

BACKGROUND OF THE INVENTION

In recent years, further increasing needs for weight reduction of automobile bodies have been promoting the application of 980 to 1470 MPa grade high-strength steel sheets to automobile frame components, bumpers, seat components, and the like. Furthermore, laser welding is being used to reduce the weight of components and increase the stiffness of components. Those being promoted are, for example, the use of tailored blanks which are produced by joining steel sheets with different thicknesses or strengths together before press forming, the formation of a closed section structure by laser welding of edges or flanges of pressed components, shortening of flanges, and increase of strength of welds as compared with conventional spot welding.

When 590 to 1470 MPa grade high-strength steel sheets are applied to automotive parts, however, a decrease in ductility thereof tends to cause cracking while pressing. In many of these steel sheets, hard martensite is formed in the microstructure of the steel sheets to improve strength and ductility. Thus, laser welding of these steel sheets causes significant softening in a heat-affected zone (hereinafter referred to as a HAZ) due to softening of the martensite. This causes a problem that a HAZ softened portion is broken during press forming or is disadvantageously broken during the deformation of a component, thereby decreasing the component strength. Thus, it is desired that these high-strength steel sheets have higher formability and less HAZ softening than before.

Under such circumstances, for example, TRIP steel containing retained γ dispersed in the microstructure of steel sheets has been developed as a technique for improving the ductility of the steel sheets. For example, Patent Literature 1 discloses that high ductile steel sheets with a TS of 80 $kgf/mm^2$ or more and TS×El≥2500 $kgf/mm^2$·% can be produced by annealing steel containing C: 0.10% to 0.45%, S: 0.5% to 1.8%, and Mn: 0.5% to 3.0% and holding the steel in the range of 350° C. to 500° C. for 1 to 30 minutes to form retained γ.

Patent Literature 2 discloses that steel sheets excellent in ductility El and stretch-flangeability λ can be produced by annealing steel containing C: 0.10% to 0.25%, Si: 1.0% to 2.0%, and Mn: 1.5% to 3.0%, cooling the steel to a temperature in the range of 450° C. to 300° C. at 10° C./s or more, and holding the steel for 180 to 600 seconds such that retained austenite is 5% by area or more, bainitic ferrite is 60% by area or more, and polygonal ferrite is 20% by area or less.

Patent Literature 3 discloses that high ductile steel sheets can be produced by annealing steel containing C: 0.10% to 0.28%, Si: 1.0% to 2.0%, and Mn: 1.0% to 3.0% in the temperature range of $A_3$ transformation temperature or more, then slowly cooling the steel to a temperature in the range of $A_3$—250° C. to $A_3$—20° C. at a cooling rate in the range of 1° C. to 10° C. to form ferrite, and then cooling the steel to the bainite transformation temperature range (320° C. to 450° C.) at a cooling rate of 11° C./s or more while avoiding ferrite transformation. The steel sheets contain bainitic ferrite: 30% to 65% by area, polygonal ferrite: 30% to 50% by area, and retained austenite: 5% to 20% by area, and have TS×El≥23000 MPa·%.

As a technique for improving HAZ softening resistance, for example, Patent Literature 4 discloses a technique for preventing temper softening of martensite in a steel sheet, which has a microstructure containing martensite: 5% to 40% and has a tensile strength of 780 MPa or more, by forming fine carbide in a heat-affected zone by allowing the steel sheet to contain C: 0.05% to 0.20%, Si: 0.005% to 1.3%, Mn: 1.0% to 3.2%, Mo: 0.05% to 0.5%, and one or two or more of Nb: 0.005% to 0.05% and Ti: 0.001% to 0.05%.

Patent Literature 5 discloses that steel sheets excellent in ductility, stretch-flangeability, and weldability can be produced by annealing a steel sheet containing C: 0.01% to 0.3%, Si: 0.005% to 2.5%, Mn: 0.01% to 3%, Mo: 0.01% to 0.3%, and Nb: 0.001% to 0.1% in a high-temperature region so as to have a microstructure close to a γ single phase, and then cooling and holding the steel sheet in the temperature range of 200° C. to 450° C. to form 50% to 97% of bainite or bainitic ferrite as a main phase and 3% to 50% of austenite as a second phase.

PATENT LITERATURE

PTL 1: Japanese Examined Patent Application Publication No. 6-35619
PTL 2: Japanese Patent No. 4411221
PTL 3: Japanese Patent No. 4716359
PTL 4: Japanese Patent No. 3881559
PTL 5: Japanese Patent No. 3854506

SUMMARY OF THE INVENTION

The conventional TRIP steel disclosed in Patent Literature 1 has high El but has a problem that the HAZ softening resistance of a weld is significantly lowered. In other words, plastic deformation at a HAZ softened portion of a laser-welded steel sheet breaks the steel sheet at the HAZ, which includes a portion softer than the base material. This makes it difficult to apply laser welding and arises a need to devise measures, such as setting a weld line at a portion that is not deformed.

The technique described in Patent Literature 2 mainly utilizes bainitic ferrite as a microstructure and an amount of ferrite is kept small. Thus, the technique has a disadvantage that the ductility is not necessarily high in spite of high stretch-flangeability.

The technique described in Patent Literature 3 utilizes ferrite as a microstructure to improve ductility but has a problem that the use of ferrite makes it difficult to increase the strength particularly to 980 MPa or more. Furthermore, HAZ softening resistance is significantly lowered.

The technique described in Patent Literature 4 aims to improve the temper softening resistance of martensite but has an insufficient effect of improving HAZ softening resistance. The technique cannot sufficiently prevent the softening of martensite in a HAZ and has an insufficient improvement effect in particular in steel sheets with a tensile strength of 980 MPa or more.

The technique described in Patent Literature 5 aims for improvements in higher-strength materials and is effective at a high laser welding speed and with a small heat input, but has the problem of significant HAZ softening in a laser output range of 4 to 6 kW and at a normal or low welding speed, such as a welding speed in the range of 3 to 5 mpm, and the problem of breakage in a HAZ in a tensile test of a joint with a laser weld line in the direction perpendicular to the tensile axis. Furthermore, ductility is not always high, and further improvement in ductility is desired. Furthermore, the technique requires the addition of a large amount of expensive Mo or Nb and therefore cost reduction is desired.

As described above, in the related art, in high-strength steel sheets particularly with a tensile strength of 980 MPa or more, no steel sheet has high ductility and high HAZ softening resistance.

Aspects of the present invention have been made to solve such problems and aims to provide a steel sheet with high ductility and still high HAZ softening resistance of a weld and a method for producing the steel sheet.

The present inventors have intensively studied on means for simultaneously achieving high ductility and high HAZ softening resistance and have reached the following conclusions.

(i) Forming a predetermined amount of coarse upper bainite adjacent to retained γ with a grain width in the range of 0.17 to 0.80 μm and an aspect ratio in the range of 4 to 25 (retained $\gamma_{UB}$) in the microstructure of steel. The coarse upper bainite is soft, and C in the upper bainite can be transferred to the retained $\gamma_{UB}$ by keeping the coarse upper bainite adjacent to the retained $\gamma_{UB}$. Thus, it is possible to form a region composed of retained γ, which is less susceptible to thermal effects, and soft bainite with a low C content that is less susceptible to thermal effects. Such a region has an effect to improve ductility also.

(ii) Adjusting the distribution density $N_\theta$ of grains with an aspect ratio of 3.5 or less and an equivalent circular diameter in the range of 0.02 to 0.25 μm to be 7/μm$^2$ or less in a microstructure composed of one or two or more of upper bainite, fresh martensite, tempered martensite, lower bainite, and retained γ. A region in which the grains have a high distribution density is composed of hard tempered martensite or lower bainite. In this region, welding further accelerates tempering and tends to cause softening. Thus, HAZ softening resistance can be improved by decreasing a region with a high grain density so that the microstructure is composed mainly of a region with a low grain density, which is less likely to be softened by tempering.

(iii) Adjusting the total area ratio $S_{\gamma Block}$ of grains with an equivalent circular diameter in the range of 1.3 to 20 μm and an aspect ratio of 3 or less to be 5% or less. These relatively coarse grains, which are often fresh martensite, significantly increase the strength of the base material but tend to cause softening due to heat input and significantly lower the HAZ softening resistance.

(iv) Such a microstructure can be formed by controlling the heating rate in an annealing step and by, in a cooling step after the annealing, holding at approximately 450° C. for a predetermined time and then cooling to approximately 200° C., and then reheating to and holding at approximately 400° C. This can improve both ductility and HAZ softening resistance.

Aspects of the present invention are based on the above findings and more specifically provide the following.

[1] A steel sheet containing, as a chemical composition, on a mass percent basis, C: 0.06% to 0.25%,
Si: 0.1% to 2.5%,
Mn: 2.0% to 3.2%,
P: 0.02% or less,
S: 0.01% or less,
sol. Al: less than 1.0% (including 0%), and
N: less than 0.015%,
wherein the total content of Si and sol. Al: Si+sol. Al ranges from 0.7% to 2.5%, the remainder is composed of Fe and incidental impurities, a steel microstructure contains ferrite: 6% to 90% by area; a microstructure composed of one or two or more of upper bainite, fresh martensite, tempered martensite, lower bainite; and retained γ: 10% to 94% by area in total; and retained γ: 3% to 20% by volume, the ratio $(S_{UB}/S_{2nd})\times100(\%)$ of the area ratio $S_{UB}$ of an upper bainite with a width in the range of 0.8 to 7 μm, a length in the range of 2 to 15 μm, and an aspect ratio of 2.2 or more in contact with retained $\gamma_{UB}$ with a grain width in the range of 0.17 to 0.80 μm and an aspect ratio in the range of 4 to 25 to the area ratio $S_{end}$ of the microstructure composed of one or two or more of upper bainite, fresh martensite, tempered martensite, lower bainite, and retained γ ranges from 2.0% to 15%, grains with an aspect ratio of 3.5 or less and an equivalent circular diameter in the range of 0.02 to 0.25 μm in the microstructure composed of one or two or more of upper bainite, fresh martensite, tempered martensite, lower bainite, and retained γ have a distribution density $N_\theta$ of 7/μm$^2$ or less (including 0/μm$^2$), and grains with an equivalent circular diameter in the range of 1.3 to 20 μm and an aspect ratio of 3 or less have a total area ratio $S_{\gamma Block}$ of 5% or less (including 0%).

[2] The steel sheet according to [1], wherein grains with an aspect ratio in the range of 3.6 to 15 and a grain width in the range of 0.14 to 0.30 μm in the microstructure composed of one or two or more of upper bainite, fresh martensite, tempered martensite, lower bainite, and retained γ have a distribution density $N_{Fine}$ in the range of 0.03 to 0.4/μm$^2$.

[3] The steel sheet according to [1] or [2], wherein the chemical composition further contains, on a mass percent basis, one or two selected from Ti: 0.002% to 0.1% and B: 0.0002% to 0.01%.

[4] The steel sheet according to any one of [1] to [3], wherein the chemical composition further contains, on a mass percent basis, one or two or more selected from
Cu: 0.005% to 1%,
Ni: 0.01% to 1%,
Cr: 0.01% to 1.0%,
Mo: 0.01% to 0.5%,
V: 0.003% to 0.5%,
Nb: 0.002% to 0.1%,
Zr: 0.005% to 0.2%, and
W: 0.005% to 0.2%.

[5] The steel sheet according to any one of [1] to [4], wherein the chemical composition further contains, on a mass percent basis, one or two or more selected from Ca: 0.0002% to 0.0040%, Ce: 0.0002% to 0.0040%, La: 0.0002% to 0.0040%, Mg: 0.0002% to 0.0030%, Sb: 0.002% to 0.1%, and Sn: 0.002% to 0.1%.

[6] The steel sheet according to any one of [1] to [5], wherein the steel sheet has a tensile strength in the range of 590 to 1600 MPa.

[7] The steel sheet according to any one of [1] to [6], having a galvanized layer on a surface of the steel sheet.

[8] A method for producing a steel sheet including: hot-rolling and cold-rolling a steel slab with a chemical composition according to any one of [1] to [5], then in a continuous annealing line, heating the cold-rolled steel sheet at 1° C./s to 6° C./s in the temperature range of 660° C. to 740° C., heating the cold-rolled steel sheet at 1° C./s to 6° C./s in the temperature range of 740° C. to 770° C., annealing the cold-rolled steel sheet in an annealing temperature range of 770° C. to 850° C., then cooling the cold-rolled steel sheet at an average cooling rate in the range of 1° C./s to 2000° C./s in the temperature range of 770° C. to 700° C., further cooling the cold-rolled steel sheet at an average cooling rate in the range of 8° C./s to 2000° C./s in the temperature range of 700° C. to 500° C., then holding the cold-rolled steel sheet in the temperature range of 500° C. to 405° C. for 13 to 200 seconds, then cooling the cold-rolled steel sheet from 405° C. to a cooling stop temperature Tsq in the range of 170° C. to 270° C. at an average cooling rate in the range of 1° C./s to 50° C./s, then heating the cold-rolled steel sheet in the temperature range of the cooling stop temperature Tsq to 350° C. at an average heating rate of 2° C./s or more, holding the cold-rolled steel sheet at 350° C. to 500° C. for 20 to 3000 seconds, and then cooling the cold-rolled steel sheet to room temperature, wherein a retention time in the temperature range of 170° C. to 250° C. between the cooling after the annealing and the heating at an average heating rate of 2° C./s or more is 50 seconds or less.

[9] The method for producing a steel sheet according to [8], wherein in the cooling from 405° C. to the cooling stop temperature Tsq in the range of 170° C. to 270° C., a cooling rate in the range of 320° C. to 270° C. is 0.3° C./s or more and less than 20° C./s.

[10] The method for producing a steel sheet according to [8] or [9], wherein a dew-point temperature in the annealing in an annealing temperature range of 770° C. to 850° C. is −45° C. or more.

[11] The method for producing a steel sheet according to any one of [8] to [10], wherein galvanizing treatment or galvannealing treatment is performed between the cooling at an average cooling rate in the range of 8° C./s to 2000° C./s in the temperature range of 700° C. to 500° C. and the holding in the temperature range of 500° C. to 405° C. for 13 to 200 seconds.

[12] The method for producing a steel sheet according to any one of [8] to [10], wherein the holding at 350° C. to 500° C. for 20 to 3000 seconds is followed by galvanizing treatment or galvannealing treatment.

Aspects of the present invention can provide a steel sheet with both high ductility and high HAZ softening resistance of a weld. Aspects of the present invention can also achieve increase of the strength.

DETAILED DESCRIPTION OF EMBODIMENTS OF THE INVENTION

Figure 1:
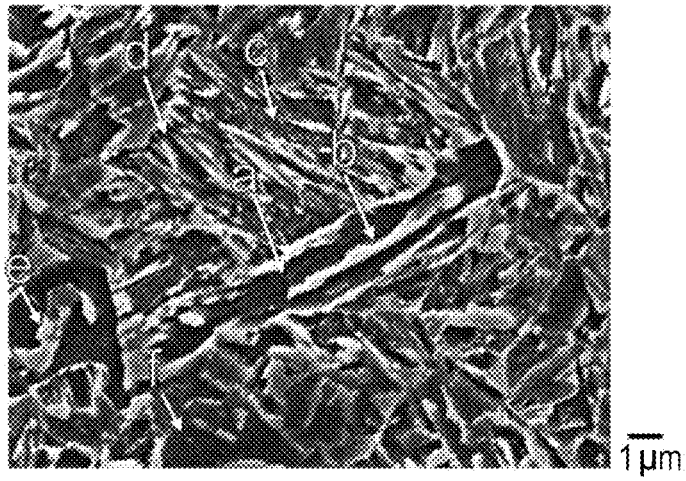
FIG. 1 is an example of a SEM image.

Embodiments of the present invention are specifically described below. The present invention is not limited to the following embodiments.

A steel sheet according to aspects of the present invention has a particular chemical composition and a particular steel microstructure. Thus, a steel sheet according to aspects of the present invention is described below in the order of the chemical composition and steel microstructure.

A steel sheet according to aspects of the present invention contains the following components. The unit "%" of the component content in the following description means "% by mass".

C: 0.06% to 0.25%

C can increase the strength of a fusion zone and a quenched zone quenched from a γ region in a welded joint and thereby reduce deformation in a HAZ and can improve HAZ softening resistance. C is contained from the perspective of securing the area ratio of tempered martensite to ensure a predetermined strength, from the perspective of securing the volume ratio of retained γ to improve ductility, and from the perspective of being concentrated in retained γ to stabilize the retained γ and improve ductility. These effects cannot be sufficiently produced at a C content of less than 0.06%. Thus, the lower limit is 0.06%, preferably 0.09% or more, more preferably 0.11% or more. A C content of more than 0.25% results in a delay in upper bainite transformation in intermediate holding in the middle of cooling and makes it difficult to form a sufficient amount of upper bainite adjacent to retained $\gamma_{UB}$. This lowers the HAZ softening resistance and ductility. Thus, the upper limit of the C content is 0.25%. From the perspective of improving the HAZ softening resistance and ductility, it is desirable that the C content be 0.22% or less. From the perspective of improving the HAZ softening resistance and ductility, it is more desirable that the C content be 0.20% or less.

Si: 0.1% to 2.5%

Si can suppress carbide formation in martensite or bainite and increase the amount of solid-solution strengthening, which is less susceptible to thermal effects, thereby improving the HAZ softening resistance in a weld and improving the stability of retained γ to improve ductility. From these perspectives, the Si content is 0.1% or more. From these perspectives, the Si content is preferably 0.6% or more, more preferably 0.8% or more, still more preferably 1.1% or more. A Si content of more than 2.5% results in extremely high rolling load and makes it difficult to produce a thin sheet. This also impairs chemical conversion treatability and the toughness of a weld. Thus, the Si content is 2.5% or less. The Si content is preferably less than 2.0% from the perspective of ensuring chemical conversion treatability and the toughness of a base material and a weld. The Si content is preferably 1.8% or less, more preferably 1.5% or less, from the perspective of ensuring the toughness of a weld.

Mn: 2.0% to 3.2%

Mn is an important element from the perspective of securing a predetermined area ratio of tempered martensite and/or bainite to ensure strength, from the perspective of stabilizing retained γ by decreasing the Ms temperature of retained γ to improve ductility, from the perspective of reducing carbide formation in bainite to improve ductility in the same manner as in Si, and from the perspective of increasing the volume ratio of retained γ to improve ductility. To produce these effects, the Mn content is 2.0% or more. From the perspective of stabilizing retained γ to improve ductility, the Mn content is preferably 2.3% or more, more preferably 2.5% or more, still more preferably 2.7% or more. A Mn content of more than 3.2% results in a delay in upper bainite transformation in the middle of cooling and makes it difficult to form a sufficient amount of upper bainite adjacent to retained $\gamma_{UB}$. This lowers the HAZ softening resistance and ductility. Thus, the Mn content is 3.2% or less. The Mn content is preferably 3.0% or less from the perspective of promoting bainite transformation to achieve high ductility, more preferably 2.9% or less.

P: 0.02% or less

Although P is an element that strengthens steel, a high P content results in low spot weldability. Thus, the P content is 0.02% or less. From the perspective of improving spot weldability, the P content is preferably 0.01% or less. Although P is not necessarily contained, the P content is preferably 0.001% or more from the perspective of production costs.

S: 0.01% or less

Although S has the effect of improving scale spalling in hot rolling and the effect of suppressing nitriding while annealing, S is an element that has great adverse effects on spot weldability, bendability, and stretch flangeability. To reduce these adverse effects, the S content is 0.01% or less. In accordance with aspects of the present invention, spot weldability tends to deteriorate due to high C, Si, and Mn contents. From the perspective of improving spot weldability, the S content is preferably 0.0020% or less, more preferably less than 0.0010%. Although S is not necessarily contained, the S content is preferably 0.0001% or more from the perspective of production costs.

Sol. Al: Less than 1.0% (Including 0%)

Al can suppress carbide formation and promote upper bainite transformation and thereby improve the HAZ softening resistance. It is desirable that the lower limit of sol. Al be, but not limited to, 0.01% or more for stable deoxidation. On the other hand, a sol. Al content of 1.0% or more results in very low base material strength and adversely affects chemical conversion treatability. Thus, the sol. Al content is less than 1.0%. The sol. Al content may be 0%. To increase the strength, the sol. Al content is preferably less than 0.50%, more preferably 0.10% or less.

N: Less than 0.015%

N is an element that forms a nitride, such as BN, AlN, or TiN, in steel and is an element that decreases the hot ductility and impairs surface quality of steel. In the case of steel containing B, N has the detrimental effect of eliminating the effects of B through the formation of BN. A N content of 0.015% or more results in very low surface quality. Thus, the N content is less than 0.015%. Although N is not necessarily contained, the N content is preferably 0.0001% or more from the perspective of production costs.

Si+Sol. Al: 0.7% to 2.5%

Si and sol. Al can improve the HAZ softening resistance. To sufficiently produce these effects, the Si and sol. Al content should be 0.7% or more, preferably 0.8% or more, more preferably 0.9% or more, particularly preferably 1.1% or more, in total. An excessively high Si and sol. Al content results in an excessive increase in ferrite or upper bainite and causes a significant decrease in strength. Thus, the Si and sol. Al content should be 2.5% or less, preferably 2.0% or less, in total.

The chemical composition of a steel sheet according to aspects of the present invention may contain the following optional elements in addition to the components described above.

Ti: 0.002% to 0.1%

Ti fixes N as TiN in steel and has the effect of improving hot ductility and the effect of activating improvement of hardenability by B. Ti also has the effect of improving HAZ softening resistance through the precipitation of TiC and a resulting finer microstructure. To produce these effects, it is desirable that the Ti content be 0.002% or more. From the perspective of sufficiently fixing N, the Ti content is more preferably 0.008% or more, still more preferably 0.010% or more. On the other hand, a Ti content of more than 0.1% results in a higher rolling load and lower ductility due to an increased amount of precipitation strengthening. Thus, it is desirable that the Ti content be 0.1% or less, preferably 0.05% or less. To achieve high ductility, the Ti content is still more preferably 0.03% or less.

B: 0.0002% to 0.01%

B is an element that improves the hardenability of steel and has the advantage of facilitating the formation of a predetermined area ratio of tempered martensite and/or bainite. B also improves hardenability in the vicinity of a weld to form a hard microstructure near the weld, and thereby improves the HAZ softening resistance. B also improves delayed fracture resistance. To produce such effects of B, the B content is preferably 0.0002% or more. The B content is more preferably 0.0005% or more, still more preferably 0.0010% or more. A B content of more than 0.01%, however, results in not only the saturation of the effects but also very low hot ductility, which causes surface defects. Thus, the B content is preferably 0.01% or less, more preferably 0.0050% or less, still more preferably 0.0030% or less.

Cu: 0.005% to 1%

Cu improves corrosion resistance in the operating environment of automobiles. A corrosion product of Cu is effective in covering the surface of a steel sheet and preventing hydrogen penetration into the steel sheet. Cu is an element that is incorporated when scrap is used as a raw material. Allowing the incorporation of Cu enables recycled materials to be used as raw materials and can reduce production costs. From such a perspective, the Cu content is preferably 0.005% or more. Further from the perspective of improving delayed fracture resistance, it is more desirable that the Cu content be 0.05% or more, more preferably 0.10% or more. An excessively high Cu content, however, results in surface defects. Thus, it is desirable that the Cu content be 1% or less, preferably 0.4% or less, more preferably 0.2% or less.

Ni: 0.01% to 1%

Like Cu, Ni is an element that can improve corrosion resistance. Ni can reduce the occurrence of surface defects, which tend to occur in the presence of Cu. Thus, it is desirable that the Ni be 0.01% or more, preferably 0.04% or more, more preferably 0.06% or more. An excessively high Ni content, however, results in uneven formation of scale in a heating furnace and causes surface defects. An excessively high Ni content also results in increased costs. Thus, it is desirable that the Ni content be 1% or less, preferably 0.4% or less, more preferably 0.2% or less.

Cr: 0.01% to 1.0%

Cr can be contained to improve the hardenability of steel and to suppress carbide formation in martensite or upper/lower bainite. Cr also improves hardenability in the vicinity of a weld, forms a hard phase near the weld, and improves the HAZ softening resistance. To produce such an effect, it is desirable that the Cr content be 0.01% or more, preferably 0.03% or more, more preferably 0.06% or more. An excessively high Cr content, however, results in low pitting corrosion resistance. Thus, it is desirable that the Cr content be 1.0% or less, preferably 0.8% or less, more preferably 0.4% or less.

Mo: 0.01% to 0.5%

Mo can be contained to improve the hardenability of steel and to suppress carbide formation in martensite or upper/lower bainite. B also improves hardenability in the vicinity of a weld to form a hard phase near the weld, and thereby improves the HAZ softening resistance. To produce such an effect, the Mo content is preferably 0.01% or more, more preferably 0.03% or more, still more preferably 0.06% or more. However, Mo significantly impairs the chemical conversion treatability of a cold-rolled steel sheet. Thus, the Mo content is preferably 0.5% or less. From the perspective of improving chemical conversion treatability, the Mo content is more preferably 0.15% or less, still more preferably less than 0.10%.

V: 0.003% to 0.5%

V can be contained to improve the hardenability of steel, to suppress carbide formation in martensite or upper/lower bainite, to make a microstructure finer, and to precipitate carbide and improve delayed fracture resistance. B also improves hardenability in the vicinity of a weld to form a hard phase near the weld, and thereby improves the HAZ softening resistance. To produce these effects, it is desirable that the V content be 0.003% or more, preferably 0.005% or more, more preferably 0.010% or more. A large amount of V, however, results in significantly low castability. Thus, it is desirable that the V content be 0.5% or less, preferably 0.3% or less, more preferably 0.1% or less.

Nb: 0.002% to 0.1%

Nb can be contained to make a steel microstructure finer and increase the strength of steel, to promote bainite transformation through grain refining, to improve bendability, and to improve delayed fracture resistance. Nb also improves hardenability in the vicinity of a weld to form a hard phase near the weld, and thereby improves the HAZ softening resistance. To produce these effects, it is desirable that the Nb content be 0.002% or more, preferably 0.004% or more, more preferably 0.010% or more. A high Nb content, however, results in excessive precipitation strengthening and causes lower ductility. A high Nb content also results in an increased rolling load and deteriorated castability. Thus, it is desirable that the Nb content be 0.1% or less, preferably 0.05% or less, more preferably 0.03% or less.

Zr: 0.005% to 0.2%

Zr can be contained to improve the hardenability of steel, to suppress carbide formation in bainite, to make a microstructure finer, and to precipitate carbide and improve delayed fracture resistance. To produce these effects, it is desirable that the Zr content be 0.005% or more, preferably 0.008% or more, more preferably 0.010% or more. A high Zr content, however, results in an increased amount of coarse precipitate, such as ZrN or ZrS, remaining unsolved during slab heating before hot rolling and causes lower delayed fracture resistance. Thus, it is desirable that the Zr content be 0.2% or less, preferably 0.15% or less, more preferably 0.08% or less.

W: 0.005% to 0.2%

W can be contained to improve the hardenability of steel, to suppress carbide formation in bainite, to make a microstructure finer, and to precipitate carbide and improve delayed fracture resistance. To produce these effects, it is desirable that the W content be 0.005% or more, preferably 0.008% or more, more preferably 0.010% or more. A high W content, however, results in an increased amount of coarse precipitate, such as WN or WS, remaining unsolved during slab heating before hot rolling and causes lower delayed fracture resistance. Thus, it is desirable that the W content be 0.2% or less, preferably 0.15% or less, more preferably 0.08% or less.

Ca: 0.0002% to 0.0040%

Ca fixes S as CaS and contributes to improved bendability or improved delayed fracture resistance. Thus, the Ca content is preferably 0.0002% or more, more preferably 0.0005% or more, still more preferably 0.0010% or more. A high Ca content, however, results in low surface quality or bendability. Thus, it is desirable that the Ca content be 0.0040% or less, preferably 0.0035% or less, more preferably 0.0020% or less.

Ce: 0.0002% to 0.0040%

Like Ca, Ce also fixes S and contributes to improved bendability or improved delayed fracture resistance. Thus, the Ce content is preferably 0.0002% or more, more preferably 0.0004% or more, still more preferably 0.0006% or more. A high Ce content, however, results in low surface quality or bendability. Thus, it is desirable that the Ce content be 0.0040% or less, preferably 0.0035% or less, more preferably 0.0020% or less.

La: 0.0002% to 0.0040%

Like Ca, La also fixes S and contributes to improved bendability or improved delayed fracture resistance. Thus, the La content is preferably 0.0002% or more, more preferably 0.0004% or more, still more preferably 0.0006% or more. A high La content, however, results in low surface quality or bendability. Thus, it is desirable that the La content be 0.0040% or less, preferably 0.0035% or less, more preferably 0.0020% or less.

Mg: 0.0002% to 0.0030%

Mg fixes O as MgO and contributes to improved delayed fracture resistance. Thus, the Mg content is preferably 0.0002% or more, more preferably 0.0004% or more, still more preferably 0.0006% or more. A high Mg content, however, results in low surface quality or bendability. Thus, it is desirable that the Mg content be 0.0030% or less, preferably 0.0025% or less, more preferably 0.0010% or less.

Sb: 0.002% to 0.1%

Sb suppresses oxidation or nitriding of a surface layer of a steel sheet and reduces a decrease in the C or B content of the surface layer. A smaller decrease in the C or B content results in suppressed ferrite formation in a surface layer of a steel sheet, which cause increased strength and improved delayed fracture resistance. From such perspectives, it is desirable that the Sb content be 0.002% or more, preferably 0.004% or more, more preferably 0.006% or more. An Sb content of more than 0.1%, however, results in deteriorated castability, and deteriorated delayed fracture resistance of a shear end face due to segregation in a prior γ grain boundary. Thus, it is desirable that the Sb content be 0.1% or less, preferably 0.04% or less, more preferably 0.03% or less.

Sn: 0.002% to 0.1%

Sn suppresses oxidation or nitriding of a surface layer of a steel sheet and reduces a decrease in the C or B content of the surface layer. A smaller decrease in the C or B content results in suppressed ferrite formation in a surface layer of a steel sheet, which causes increased strength, and improved delayed fracture resistance. From such perspectives, it is desirable that the Sn content be 0.002% or more, preferably 0.004% or more, more preferably 0.006% or more. A Sn content of more than 0.1%, however, results in deteriorated castability. This also results in deteriorated delayed fracture resistance of a shear end face due to segregation of Sn in a prior γ grain boundary. Thus, it is desirable that the Sn content be 0.1% or less, preferably 0.04% or less, more preferably 0.03% or less.

The remainder is composed of Fe and incidental impurities. When the above optional components are contained below their respective lower limits, optional elements below their lower limits do not reduce the advantages according to aspects of the present invention. Thus, if present at all, optional elements below their lower limits are regarded as being contained as incidental impurities.

The steel microstructure of a steel sheet according to aspects of the present invention is described below.

Ferrite: 6% to 90%

To achieve high ductility, the area ratio of ferrite is 6% or more. From the perspective of achieving high ductility, the area ratio of ferrite is preferably 8% or more, more preferably more than 10%. An excessive increase in ferrite, however, results in lower strength and suppressed upper bainite formation. Thus, the area ratio of ferrite is 90% or less. From the perspective of ensuring strength, the area ratio of ferrite is preferably 85% or less, more preferably 70% or less. Ferrite herein refers to polygonal ferrite.

Microstructure Composed of One or Two or More of Upper Bainite, Fresh Martensite, Tempered Martensite, Lower Bainite, and Retained γ: 10% to 94%

To ensure predetermined strength and ductility, the total area ratio of upper bainite, fresh martensite, tempered martensite, lower bainite, and retained γ in the remainder other than polygonal ferrite ranges from 10% to 94%. The lower limit is preferably 15% or more, more preferably 30% or more. The area ratio of each microstructure of upper bainite, fresh martensite, tempered martensite, and lower bainite is typically in the following range. The area ratio of upper bainite ranges from 1% to 30%. The area ratio of fresh martensite ranges from 0% to 10%. The area ratio of tempered martensite ranges from 2% to 60%. The area ratio of lower bainite ranges from 2% to 70%.

Retained γ: 3% to 20%

To achieve high ductility, the volume fraction of retained γ is 3% or more of the entire steel microstructure, preferably 6% or more, more preferably 8% or more. The content of retained γ includes those of retained γ formed adjacent to upper bainite and retained γ formed adjacent to martensite or lower bainite. An excessively high retained γ content results in lower strength, lower stretch-flangeability, and deteriorated delayed fracture resistance. Thus, the volume fraction of retained γ is 20% or less, preferably 15% or less. The "volume fraction" can be regarded as the "area ratio".

The ratio $(S_{UB}/S_{2nd})\times100(\%)$ of the area ratio $S_{UB}$ of an upper bainite with a width in the range of 0.8 to 7 μm, a length in the range of 2 to 15 μm, and an aspect ratio of 2.2 or more in contact with retained $\gamma_{UB}$ with a grain width in the range of 0.17 to 0.80 μm and an aspect ratio in the range of 4 to 25 to the area ratio $S_{2nd}$ of the microstructure composed of one or two or more of upper bainite, fresh martensite, tempered martensite, lower bainite, and retained γ ranges from 2.0% to 15%.

In a production method described later, a predetermined amount of retained $\gamma_{UB}$ adjacent to upper bainite (bainitic ferrite) containing little carbide can be formed by holding in the intermediate temperature range of 500° C. to 405° C. in a cooling step. The retained $\gamma_{UB}$ grains have a grain width in the range of 0.17 to 0.80 μm and an aspect ratio in the range of 4 to 25. Retained $\gamma_{UB}$ adjacent to coarse upper bainite allows C in the upper bainite to be transferred to the retained $\gamma_{UB}$ and to be locally concentrated. Consequently, the upper bainite contains little solute C and is therefore less susceptible to thermal effects. Furthermore, carbon transfer from upper bainite to adjacent retained $\gamma_{UB}$ can form retained γ, which is less susceptible to thermal effects. Upper bainite that is effective in improving the HAZ softening resistance is in contact with the retained $\gamma_{UB}$ and has a width in the range of 0.8 to 4 μm, a length in the range of 2 to 15 μm, and an aspect ratio of 2.2 or more. It is necessary to control the ratio of the area ratio $S_{UB}$ of the upper bainite to the total area ratio $S_{2nd}$ of the microstructure composed of one or two or more of fresh martensite, tempered martensite, lower bainite, and retained γ. In accordance with aspects of the present invention, the HAZ softening resistance is improved when the ratio $(S_{UB}/S_{2nd})\times100(\%)$ is 2.0% or more. Ductility is also improved. From the perspective of improving the HAZ softening resistance, $(S_{UB}/S_{2nd})\times100(\%)$ is preferably 3.0% or more. An excessively high area ratio $S_{UB}$ of upper bainite results in a significant strength reduction of the base material. This also results in lower ductility, stretch-flangeability, and delayed fracture resistance. Thus, the $(S_{UB}/S_{2nd})\times100(\%)$ is 15% or less, preferably 12% or less, more preferably 10% or less. The area ratios $S_{UB}$ and $S_{2nd}$ refer to the area ratios relative to the entire steel microstructure.

Grains with an aspect ratio of 3.5 or less and an equivalent circular diameter in the range of 0.02 to 0.25 μm in the microstructure composed of one or two or more of upper bainite, fresh martensite, tempered martensite, lower bainite, and retained γ have a distribution density $N_\theta$ of 7/μm$^2$ or less (including 0/μm$^2$).

Grains with an aspect ratio of 3.5 or less and an equivalent circular diameter in the range of 0.02 to 0.25 μm in the microstructure composed of one or two or more of upper bainite, fresh martensite, tempered martensite, lower bainite, and retained γ are composed mainly of a carbide. The region in which the carbide is densely distributed is hard tempered martensite and/or lower bainite and tends to be softened by thermal effects. Thus, from the perspective of improving the HAZ softening resistance, grains with an aspect ratio of 3.5 or less and an equivalent circular diameter in the range of 0.02 to 0.25 μm in the microstructure composed of one or two or more of upper bainite, fresh martensite, tempered martensite, lower bainite, and retained γ have a distribution density $N_\theta$ of 7/μm$^2$ or less, preferably 6/μm$^2$ or less, more preferably 4/μm$^2$ or less. It is desirable that the lower limit of the distribution density of the grains be, but not limited to, 0/μm$^2$. The carbide is significantly formed when the cooling rate in the temperature range of 320° C. or less is too high or when the holding time at a low temperature of 250° C. or less is too long.

Grains with an aspect ratio in the range of 3.6 to 15 and a grain width in the range of 0.14 to 0.30 μm in the microstructure composed of one or two or more of upper bainite, fresh martensite, tempered martensite, lower bainite, and retained γ have a distribution density $N_{Fine}$ in the range of 0.03 to 0.4/μm$^2$ (preferable conditions).

Grains with an aspect ratio in the range of 3.6 to 15 and a grain width in the range of 0.14 to 0.30 μm in the microstructure composed of one or two or more of upper bainite, fresh martensite, tempered martensite, lower bainite, and retained γ are mainly retained γ formed in lower bainite (and the periphery thereof). The grains have both the effect of improving ductility and the effect of improving HAZ softening resistance. To produce the effects, grains with an aspect ratio in the range of 3.6 to 15 and a grain width in the range of 0.14 to 0.30 μm in the microstructure composed of one or two or more of upper bainite, fresh martensite, tempered martensite, lower bainite, and retained γ preferably have a distribution density $N_{Fine}$ of 0.03/μm$^2$ or more, more preferably 0.04/μm$^2$ or more, still more preferably 0.05/μm$^2$ or more. An excessively large number of such grains results in lower λ. Thus, the grains preferably have a distribution density $N_{Fine}$ of 0.4/μm$^2$ or less, more preferably 0.3/μm$^2$ or less.

Grains with an equivalent circular diameter in the range of 1.3 to 20 μm and an aspect ratio of 3 or less have a total area ratio $S_{\gamma Block}$ of 5% or less (including 0%).

This microstructure is composed mainly of fresh martensite. Conventional TRIP steel produced by austempering contains a large number of these grains and has low HAZ softening resistance. In the cooling step after the annealing, rapid cooling at 405° C. or less and further cooling to 270° C. or less at a moderately low cooling rate in a low-temperature region of 320° C. or less can decrease the amount of the massive microstructure. To achieve high HAZ softening resistance, grains with an equivalent circular diameter in the range of 1.3 to 20 μm and an aspect ratio of 3 or less should have a total area ratio $S_{\gamma Block}$ of 5% or less, preferably 4% or less, more preferably 3% or less.

A method for measuring a steel microstructure is described below.

Figure 2:
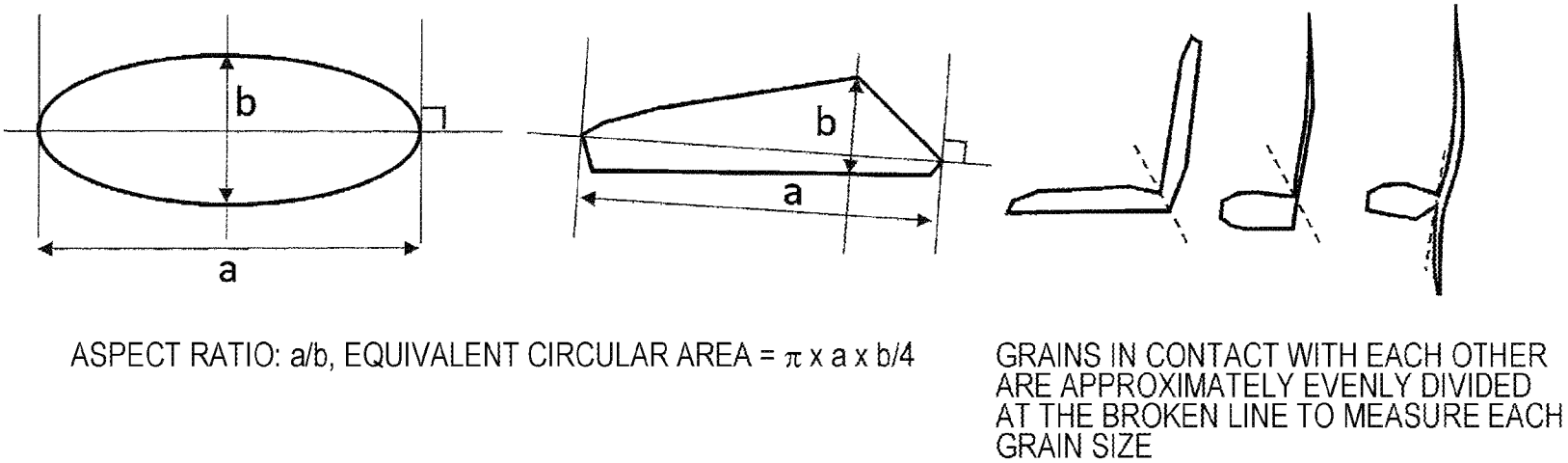
FIG. 2 is an explanatory view of the aspect ratio, grain width, and grain length.

The morphology and area ratio of ferrite, retained $\gamma_{UB}$, and upper bainite were measured by cutting out a cross section in the thickness direction parallel to the rolling direction, mirror-polishing the cross section, etching the cross section in 3% by volume nital, and observing eight fields at a ¼ thickness position with a SEM at a magnification of 5000. Ferrite to be observed was equiaxed polygonal ferrite with little carbide inside and an aspect ratio of less than 2.2. This appears as the blackest region when observed with the SEM. Retained $\gamma_{UB}$, appears as white grains when observed with the SEM. Upper bainite contains little carbide inside, like ferrite, and is a region that appears black when observed with the SEM (scanning electron microscope). A region with an aspect ratio 2.2 is classified as upper bainite (bainitic ferrite) to calculate the area ratio $S_{UB}$. As illustrated in FIG. 2, the aspect ratio a/b was calculated from the major axis length a, which is the longest grain length, and the minor axis length b, which is the longest grain length in the direction perpendicular to the major axis. In the case of a plurality of grains in contact with each other, the grains are approximately evenly divided at the broken line shown in FIG. 2 in a region where individual grains are in contact with each other, and the size of each grain is measured.

The area ratio $S_{end}$ of the microstructure composed of one or two or more of upper bainite, fresh martensite, tempered martensite, lower bainite, and retained γ was measured in the same manner as in ferrite. This area ratio is the area ratio of the region other than the ferrite. The area ratio included the area ratio of carbide, because the area ratio of carbide was very small.

The volume fraction of retained γ was determined by X-ray diffractometry after chemical polishing at a ¼ thickness position from the surface layer. The incident X-ray was from a Co-Kα radiation source. The area ratio of retained austenite was calculated from the intensity ratios of the (200), (211), and (220) planes of ferrite and the (200), (220), and (311) planes of austenite. Because retained γ is randomly distributed, the volume fraction of retained γ determined by X-ray diffractometry is equal to the area ratio of retained γ in the steel microstructure.

Likewise, the distribution density $N_\theta$ of grains with an aspect ratio of 3.5 or less and an equivalent circular diameter in the range of 0.02 to 0.25 μm in the microstructure composed of one or two or more of upper bainite, fresh martensite, tempered martensite, lower bainite, and retained γ was also determined from a SEM photograph. The area to be measured for the distribution density is in the above microstructure and does not include ferrite. Thus, the number of grains of the relevant size in the microstructure (and the periphery thereof) is determined and is divided by the area of the microstructure to obtain the distribution density $N_\theta$.

The equivalent circular size (equivalent circular diameter) was determined by observing individual grains with a SEM, determining the area ratio, and calculating the equivalent circular diameter.

Likewise, the distribution density $N_{Fine}$ of grains with an aspect ratio in the range of 3.6 to 40 and a grain width in the range of 0.14 to 0.30 μm in the microstructure composed of one or two or more of upper bainite, fresh martensite, tempered martensite, lower bainite, and retained γ was also determined from a SEM photograph. The area to be measured for the distribution density is the above microstructure and does not include ferrite. Thus, the number of grains of the relevant size in the microstructure (and the periphery thereof) is determined and is divided by the area of the microstructure to obtain the distribution density $N_{Fine}$.

Likewise, the total area ratio $S_{\gamma Block}$ of grains with an equivalent circular diameter in the range of 1.3 to 20 μm and an aspect ratio of 3 or less was also determined from a SEM photograph.

FIG. 1 is an example of a SEM photograph.

In the case of a steel sheet used for the observation in FIG. 1, 0.18% C-1.5% Si-2.8% Mn steel was heated to 630° C. at 20° C./s and was then heated from 630° C. to 800° C. at a constant heating rate of 3° C./s. The steel was annealed at 800° C., was then cooled to 450° C. at a constant cooling rate of 20° C./s, was then held at 450° C. for 30 seconds, was then cooled to 320° C. at a constant cooling rate of 15° C./s, was then cooled from 320° C. to 270° C. at 6° C./s, and was then cooled from 270° C. to 200° C. at 5° C./s. After reaching 200° C., the steel was immediately heated to 400° C. at 15° C./s, was held at 400° C. for 10 minutes, and was then cooled to 100° C. or less at 10° C./s. A vertical cross section at a ¼ thickness position in the rolling direction was polished, was etched in 3% nital, and was observed with a SEM.

Upper bainite, fresh martensite, tempered martensite, lower bainite, and retained γ are individually evaluated in a SEM photograph. Upper bainite (a) is a microstructure that contains little carbide, almost no streaked strain (lath interface) being observed inside thereof, is black like ferrite, and has a width in the range of 0.8 to 7 μm, a length in the range of 2 to 15 μm, and an aspect ratio of 2.2 or more. Grains with a grain width in the range of 0.17 to 0.80 μm and an aspect ratio in the range of 4 to 25 are retained $\gamma_{UB}$ (b). Tempered martensite (c) is a region that contains 2.0 to 20 per μm$^2$ of fine carbids with an aspect ratio of 3.5 or less and an equivalent circular diameter in the range of 0.02 to 0.25 μm in the microstructure. Lower bainite (d) is a region that contains 0 to 4 per $\mu m^2$ of film-like grains with a grain width in the range of 0.14 to 0.30 μm and an aspect ratio in the range of 3.6 to 15 and contains 0 to 1.9 per $\mu m^2$ of fine carbide grains with an aspect ratio of 3.5 or less and an equivalent circular diameter in the range of 0.02 to 0.25 μm in the microstructure. The tempered martensite and lower bainite, streaked strain (lath interface) being observed inside thereof, are slightly grayer than the ferrite or upper bainite. Fresh martensite (e) includes massive white grains with an aspect ratio of approximately 3 or less and an equivalent circular diameter of 0.26 μm or more. The (e) also includes some massive γ. A black region with little carbide and with an aspect ratio of 2.1 or less is identified as polygonal ferrite (f).

A steel sheet according to aspects of the present invention preferably has a tensile strength of 590 MPa or more, more preferably 980 MPa or more, still more preferably 1180 MPa or more. The upper limit of the tensile strength is preferably 1600 MPa or less, more preferably 1450 MPa or less, from the perspective of ensuring other characteristics.

A steel sheet according to aspects of the present invention may have a galvanized layer on the surface of the steel sheet. The galvanized layer may be a galvannealed layer formed by alloying treatment.

A method for producing a steel sheet according to aspects of the present invention is described below.

Hot-Rolling

A slab may be hot-rolled by a method of heating and then rolling the slab, a method of directly rolling a continuously cast slab without heating, or a method of heating a continuously cast slab for a short time and then rolling the slab. Hot rolling may be performed in the usual manner. For example, the slab heating temperature ranges from 1100° C. to 1300° C., the soaking time ranges from 20 to 300 minutes, the finish rolling temperature ranges from $Ar_3$ transformation temperature to $Ar_3$ transformation temperature+200° C., and the coiling temperature ranges from 400° C. to 720° C. The coiling temperature preferably ranges from 430° C. to 530° C. from the perspective of reducing thickness variations and stably ensuring high strength.

Cold Rolling

In cold rolling, the rolling reduction may range from 30% to 85%. From the perspective of stably ensuring high strength and decreasing anisotropy, the rolling reduction preferably ranges from 45% to 85%. In the case of high rolling load, softening annealing treatment may be performed at 450° C. to 730° C. in a continuous annealing line (CAL) or a box annealing furnace (BAF).

Annealing in Continuous Annealing Line

A steel slab with a predetermined chemical composition is hot rolled and cold rolled, and then is annealed in a continuous annealing line under the conditions specified below. Although annealing equipment is not particularly limited, a continuous annealing line (CAL) or a continuous galvanizing line (CGL) is preferred from the perspective of ensuring productivity, a desired heating rate, and a desired cooling rate.

Heating Rate in Temperature Range of 660° C. to 740° C.: 1° C./s to 6° C./s

Slow heating at 1° C./s to 6° C./s in this temperature range improves the HAZ softening resistance. An excessively high heating rate in this temperature range results in the formation of austenite in the state before recrystallization by reverse transformation to cause excessively fine austenite. In finely dispersed austenite, even holding at approximately 450° C. in a subsequent cooling step forms insufficient coarse upper bainite and does not produce the effect of improving HAZ softening resistance. To produce such an effect, the heating rate in the temperature range of 660° C. to 740° C. should be 6° C./s or less, preferably 5° C./s or less. An excessively low heating rate reduces the productivity. Thus, heating rate is 1° C./s or more, preferably 2° C./s or more.

Heating Rate in Temperature Range of 740° C. to 770° C.: 1° C./s to 6° C./s

Slow heating at 1° C./s to 6° C./s in this temperature range improves the HAZ softening resistance. An excessively high heating rate in this temperature range results in an excessively large number of austenite nucleation sites to cause excessively fine austenite. In finely dispersed austenite, even holding at approximately 450° C. in a subsequent cooling step forms insufficient coarse upper bainite and does not produce the effect of improving HAZ softening resistance. The heating rate is preferably 5° C./s or less.

Annealing Temperature: 770° C. to 850° C.

To ensure a predetermined area ratio of tempered martensite and/or bainite and a predetermined volume fraction of retained γ, the annealing temperature ranges from 770° C. to 850° C. An annealing temperature of less than 770° C. results in a decreased $S_{UB}$ of upper bainite and lower HAZ softening resistance. An annealing temperature of more than 850° C. results in a decrease in the formation of ferrite and lower ductility.

The Dew-Point Temperature in Annealing in an Annealing Temperature Range of 770° C. to 850° C. is −45° C. or More (Preferable Conditions)

The dew-point temperature in the annealing in an annealing temperature range of 770° C. to 850° C. is adjusted to −45° C. or more to promote the formation of a decarburized layer on the surface layer and to decrease the distribution density $N_\theta$ of grains (mainly carbide) with an aspect ratio of 3.5 or less and an equivalent circular diameter in the range of 0.02 to 0.25 μm in the microstructure composed of one or two or more of upper bainite, fresh martensite, tempered martensite, lower bainite, and retained γ. This suppresses excessive temper softening in the surface layer and improves the HAZ softening resistance. To produce such effects, the dew-point temperature in the annealing in an annealing temperature range of 770° C. to 850° C. is preferably −45° C. or more, more preferably −40° C. or more, still more preferably −35° C. or more. Due to possible roll degradation caused by pickup at a dew-point temperature of more than 10° C., the dew-point temperature is preferably 10° C. or less.

Average Cooling Rate in Temperature Range of 770° C. to 700° C.: 1° C./s to 2000° C./s After the annealing, cooling is performed at an average cooling rate of 1° C./s to 2000° C./s in the temperature range of 770° C. to 700° C. An average cooling rate of less than 1° C./s results in the formation of a large amount of ferrite and a decreased $S_{UB}$ of upper bainite to cause lower strength, lower HAZ softening resistance, and lower λ. 3° C./s or more is more preferred. On the other hand, an excessively high average cooling rate results in a poor sheet shape. Thus, the average cooling rate is 2000° C./s or less, preferably 100° C./s or less, more preferably less than 30° C./s.

Average Cooling Rate in Temperature Range of 700° C. to 500° C.: 8° C./s to 2000° C./s Cooling is performed at 8° C./s or more in the temperature range of 700° C. to 500° C. An average cooling rate of less than 8° C./s results in the formation of a large amount of ferrite and a decreased $S_{UB}$ of upper bainite to cause lower strength, lower HAZ softening resistance, and lower λ. 10.0° C./s or more is more preferred. On the other hand, an excessively high average cooling rate results in a poor sheet shape. Thus, the average cooling rate is 2000° C./s or less, preferably 100° C./s or less, more preferably less than 30° C./s.

Galvanizing Treatment or Galvannealing Treatment (Preferable Conditions)

Galvanizing treatment or galvannealing treatment can be performed between the cooling at an average cooling rate in the range of 8° C./s to 2000° C./s in the temperature range of 700° C. to 500° C. and the holding in the temperature range of 500° C. to 405° C. for 13 to 200 seconds described later. The galvanizing treatment is preferably performed by immersing a steel sheet in a hot-dip galvanizing bath at 440° C. to 500° C. and then adjusting the coating weight by gas wiping or the like. When the zinc coating is further alloyed, alloying in the temperature range of 460° C. to 580° C. for a retention time of 1 to 120 seconds is preferred. The cooling at an average cooling rate in the range of 8° C./s to 2000° C./s in the temperature range of 700° C. to 500° C. may be followed by heating to 500° C. or more, if necessary. The zinc coating is preferably formed in a galvanizing bath with an Al content of 0.08% to 0.25% by mass. The galvanized steel sheet may be subjected to a coating treatment, such as resin or fat or oil coating.

Holding Time in Temperature Range of 500° C. to 405° C.: 13 to 200 Seconds

Holding in this temperature range for a predetermined time can form upper bainite with little carbide precipitation. Furthermore, retained $\gamma_{UB}$ with a high concentrated content of C can be formed adjacent thereto. Holding in the temperature range can achieve $(S_{UB}/S_{2nd})\times100(\%)=2.0\%$ or more and improve the HAZ softening resistance. From such perspectives, the holding time in the temperature range of 500° C. to 405° C. is 13 seconds or more, preferably 15 seconds or more. A holding time of more than 200 seconds, however, results in almost no further formation of bainite, promotes carbon concentration in massive untransformed γ, and causes an increase in the amount of residual massive microstructure. This lowers the HAZ softening resistance. Thus, the holding time in the temperature range of 500° C. to 405° C. ranges from 13 to 200 seconds. From the perspective of improving stretch-flangeability, the holding time in the temperature range of 500° C. to 405° C. is preferably 100 seconds or less. Such holding in this temperature range corresponds to decreasing the average cooling rate to 7.3° C./s or less in the temperature range. From the perspective of improving ductility, the holding temperature range is preferably 410° C. or more, more preferably 430° C. or more, and preferably 490° C. or less, more preferably 480° C. or less.

Average Cooling Rate from 405° C. to Cooling Stop Temperature Tsq in Range of 170° C. to 270° C.: 1° C./s to 50° C./s Moderately slow cooling is performed in the temperature range from 405° C. to a cooling stop temperature Tsq in the range of 170° C. to 270° C. This can concentrate carbon into adjacent γ simultaneously with the formation of martensite and lower bainite, and reduce the formation of carbide with an aspect ratio of 3.5 or less and an equivalent circular diameter in the range of 0.02 to 0.25 μm, reduce the formation of massive fresh martensite with an equivalent circular diameter in the range of 1.3 to 20 μm and an aspect ratio of 3 or less, to soften the martensite and lower bainite, and thereby produce the effect of improving HAZ softening resistance. This also improves ductility. From these perspectives, the average cooling rate in the temperature range ranges from 1° C./s to 50° C./s. From the perspective of suppressing the formation of carbide, it is desirable that the average cooling rate in the temperature range be less than 15° C./s, preferably less than 10° C./s.

Average Cooling Rate in Range of 320° C. to 270° C. in Cooling from 405° C. to Cooling Stop Temperature Tsq in Range of 170° C. to 270° C.: 0.3° C./s or More and Less than 20° C./s (Preferable Conditions)

Slow cooling in the range of 320° C. to 270° C. is preferable to distribute carbon from martensite and/or lower bainite to γ and thereby suppress the formation of carbide with an aspect ratio of 3.5 or less and an equivalent circular diameter in the range of 0.02 to 0.25 μm and to have a distribution density $N_{Fine}$ of grains with an aspect ratio in the range of 3.6 to 15 and a grain width in the range of 0.14 to 0.30 μm in the range of 0.03 to 0.4/μm$^2$. From such perspectives, it is desirable that the cooling rate in the temperature range be 0.3° C./s or more and less than 20° C./s, more desirably 0.3° C./s or more and less than 10° C./s.

Cooling Stop Temperature Tsq: 170° C. to 270° C.

The cooling stop temperature Tsq should range from 170° C. to 270° C. for grains with an equivalent circular diameter in the range of 1.3 to 20 μm and an aspect ratio of 3 or less to have a total area ratio $S_{\gamma Block}$ of 5% or less and to ensure the amount of retained γ.

Average Heating Rate in the Temperature Range of Cooling Stop Temperature Tsq to 350° C.: 2° C./s or More Further heating for a short time in the temperature range of the cooling stop temperature Tsq to 350° C. can suppress carbide precipitation and achieve high ductility. Thus, the average heating rate in the temperature range of the cooling stop temperature Tsq to 350° C. is 2° C./s or more. From such perspectives, it is desirable that the average heating rate be 5° C./s or more, preferably 10° C./s or more. The upper limit of the average heating rate is preferably, but not limited to, 50° C./s or less, more preferably 30° C./s or less.

Retention Time in the Temperature Range of 170° C. to 250° C. in the step from the cooling after the annealing to heating at an Average Heating Rate of 2° C./s or More: 50 Seconds or Less Holding in the temperature range of 250° C. or less retards the diffusion of C from martensite and/or lower bainite to γ and promotes carbide precipitation. This hardens these microstructures and lowers the HAZ softening resistance. Thus, the retention time in the temperature range of 170° C. to 250° C. in the step from the cooling after the annealing to heating at an average heating rate of 2° C./s or more described later should be 50 seconds or less. From such perspectives, the retention time is preferably 30 seconds or less.

Holding Time at 350° C. to 500° C.: 20 to 3000 Seconds

Holding in the temperature range of 350° C. to 500° C. for 20 to 3000 seconds is performed from the perspective of distributing C to retained $\gamma_{UB}$ formed by intermediate holding (holding in the temperature range of 500° C. to 405° C. for 13 to 200 seconds) or retained γ formed adjacent to martensite or lower bainite to stabilize them and improving ductility and HAZ softening resistance and from the perspective of subdividing regions distributed in a massive form as untransformed γ by bainite transformation and improving λ. The holding time in the temperature range is preferably 240 seconds or more from the perspective of further improving the ductility, more preferably 300 seconds or more from the perspective of improving the HAZ softening resistance.

The steel sheet is then cooled to room temperature and can be subjected to skin pass rolling from the perspective of stabilizing press formability by such as adjusting the surface roughness or flattening the sheet shape, and from the perspective of increasing the yield strength (YS). The skin pass elongation percentage preferably ranges from 0.1% to 0.5%. The sheet shape may be flattened with a leveler.

When galvanizing treatment or galvannealing treatment is not performed between the cooling at an average cooling rate in the range of 8° C./s to 2000° C./s in the temperature range of 700° C. to 500° C. and the holding in the temperature range of 500° C. to 405° C. for 13 to 200 seconds, galvanizing treatment or galvannealing treatment may be performed after holding in the temperature range of 350° C. to 500° C. for 20 to 3000 seconds (preferable conditions). When performed, the galvanizing treatment is preferably performed by immersing the steel sheet in a hot-dip galvanizing bath at 440° C. to 500° C. and then adjusting the coating weight by gas wiping or the like. When the zinc coating is further alloyed, alloying in the temperature range of 460° C. to 580° C. for a retention time of 1 to 120 seconds is preferred. From the perspective of preventing the decomposition of retained γ, 550° C. or less is more preferred. The zinc coating is preferably formed in a galvanizing bath with an Al content of 0.08% to 0.25% by mass. The galvanized steel sheet may be subjected to a coating treatment, such as resin or fat or oil coating.

From the perspective of improving stretch-flangeability, after the above described heat treatment or the skin pass rolling, a low-temperature heat treatment may be performed in the temperature range of 100° C. to 300° C. for 30 seconds to 10 days. This treatment causes hydrogen that has penetrated into the steel sheet during the tempering or annealing of martensite formed by the final cooling or the skin pass rolling to be eliminated from the steel sheet. The low-temperature heat treatment can decrease hydrogen to less than 0.1 ppm. Electroplated coating may also be performed. Electroplated coating is preferably followed by the low-temperature heat treatment from the perspective of decreasing the hydrogen content of the steel.

Working examples can have TS×El≥17000 MPa·%, which is important as an index of the formability of a component with a complex shape including stretch forming and stretch flange forming, and can prevent a breakage originated from a HAZ of a weld.

Example 1

A cold-rolled steel sheet 1.4 mm in thickness with a chemical composition listed in Table 1 was treated under the annealing conditions listed in Table 2 to produce steel sheets according to aspects of the present invention and comparative examples.

Part of the steel sheets (cold-rolled steel sheets: CR) were subjected to hot-dip galvanizing treatment after holding in the temperature range of 350° C. to 500° C. to form hot-dip galvanized steel sheets (GI). More specifically, a steel sheet was immersed in a galvanizing bath in the temperature range of 440° C. to 500° C. for hot-dip galvanizing treatment. Subsequently, the amount of coating was adjusted by gas wiping or the like. The hot-dip galvanizing was performed in a galvanizing bath with an Al content in the range of 0.10% to 0.22%. After the hot-dip galvanizing treatment, part of the hot-dip galvanized steel sheets were subjected to alloying treatment to form galvannealed steel sheets (GA). The alloying treatment was performed in the temperature range of 460° C. to 580° C. Part of the steel sheets (cold-rolled steel sheets: CR) were subjected to electroplated coating to form electrogalvanized steel sheets (EG).

The steel microstructure was determined by the method described above. Table 3 shows the measurement results.

JIS No. 5 tensile test specimens were taken from the steel sheets and were subjected to a tensile test (according to JIS Z 2241). Table 3 shows TS and El.

Two steel sheets 150 mm in the direction perpendicular to the rolling direction and 125 mm in the rolling direction (end surfaces were ground) were taken from the steel sheets, were placed opposite and abutting each other in the rolling direction, and were laser-welded at the abutting position. The gap between abutting surfaces was 0 mm under the condition A or 0.15 mm under the condition B. Under the condition B, the fusion zone has a smaller cross-sectional area, and therefore the evaluation is stricter. In the laser welding, Nd-YAG laser was used, the spot diameter at the focal position was 0.6 mm, the focal position was a 4-mm upper position above the steel sheet, the shielding gas was Ar, the laser output was 4.2 kW, and the welding speed was 3.7 m/min. A JIS No. 5 tensile test specimen was taken from the welded member such that the weld line was perpendicular to the tensile axis and was positioned in the longitudinal center of the test specimen (according to JIS Z 2241). Fracture with separation of a breaking point from the weld line by 2.0 mm or more (separation of even part thereof by more than 2.0 mm) was considered to be base material fracture. Fracture with separation of a breaking point from the weld line by less than 2.0 mm and fracture with a crack along the weld line (a crack in a HAZ or fusion zone) was considered to be weld fracture. Base metal fracture under the laser welding condition A (O) was considered to be high HAZ softening resistance.

In the working examples, TS×El≥17000 MPa·% is satisfied, and the laser-welded portion can also have base material fracture.

The working examples Nos. 1, 11, 12, 18, 26, 29, 32, 33, and 37 have $(S_{UB}/S_{2nd})\times100(\%)$ of 3.0 or more, $N_\theta$ of 5/μm$^2$ or less, $N_{Fine}$ of 0.03/μm$^2$ or more, and $S_{\gamma Block}$ of 5% or less, have base material fracture even under the condition B including a gap in butt welding, have ductility satisfying TS×El≥19000 MPa·%, and are therefore particularly good.

TABLE 1

| Steel | Chemical composition (% by mass) | | | | | | | | Si + | |
|---|---|---|---|---|---|---|---|---|---|---|
| No. | C | Si | Mn | P | S | sol. Al | N | others | sol. Al | Note |
| A | 0.198 | 1.50 | 2.65 | 0.004 | 0.0002 | 0.072 | 0.0029 | Nb: 0.006, Ti: 0.015, B: 0.0011 | 1.6 | Example steel |
| B | 0.240 | 0.54 | 2.90 | 0.007 | 0.0012 | 0.040 | 0.0036 | Nb: 0.012, Ti: 0.035, B: 0.0012 | 0.6 | Comparative example steel |
| C | 0.118 | 1.76 | 2.83 | 0.010 | 0.0007 | 0.272 | 0.0031 | — | 2.0 | Example steel |

TABLE 1-continued

| Steel No. | Chemical composition (% by mass) C | Si | Mn | P | S | sol. Al | N | others | Si + sol. Al | Note |
|---|---|---|---|---|---|---|---|---|---|---|
| D | 0.264 | 1.67 | 2.45 | 0.005 | 0.0005 | 0.197 | 0.0056 | — | 1.9 | Comparative example steel |
| E | 0.053 | 1.02 | 2.92 | 0.002 | 0.0019 | 0.010 | 0.0045 | — | 1.0 | Comparative example steel |
| F | 0.168 | 1.71 | 2.76 | 0.011 | 0.0018 | 0.137 | 0.0068 | Ti: 0.018, B: 0.0025 | 1.8 | Example steel |
| G | 0.216 | 2.55 | 2.81 | 0.004 | 0.0016 | 0.411 | 0.0035 | Ti: 0.024, B: 0.0080 | 3.0 | Comparative example steel |
| H | 0.132 | 0.08 | 2.99 | 0.010 | 0.0016 | 0.193 | 0.0051 | Ti: 0.950, B: 0.0013 | 0.3 | Comparative example steel |
| I | 0.242 | 0.31 | 2.07 | 0.010 | 0.0011 | 0.401 | 0.0047 | Cu: 0.010, Ni: 0.02, Cr: 0.02, Mo: 0.05 | 0.7 | Example steel |
| J | 0.210 | 1.62 | 2.78 | 0.006 | 0.0018 | 0.367 | 0.0040 | V: 0.010, Zr: 0.007, W: 0.011 | 2.0 | Example steel |
| K | 0.134 | 1.85 | 3.25 | 0.008 | 0.0012 | 0.242 | 0.0066 | Cu: 0.010, Ni: 0.02, Cr: 0.02, Nb: 0.094 | 2.1 | Comparative example steel |
| L | 0.201 | 1.64 | 1.91 | 0.005 | 0.0014 | 0.371 | 0.0038 | V: 0.010 | 2.0 | Comparative example steel |
| M | 0.088 | 2.48 | 3.14 | 0.008 | 0.0010 | 0.020 | 0.0042 | Ca: 0.0006, Ce: 0.0005, La: 0.001 | 2.5 | Example steel |
| N | 0.189 | 2.00 | 2.74 | 0.009 | 0.0005 | 0.291 | 0.0060 | Mg: 0.0007, Sb: 0.01, Sn: 0.01 | 2.3 | Example steel |
| O | 0.126 | 1.65 | 2.65 | 0.007 | 0.0005 | 1.100 | 0.0044 | Sb: 0.08 | 2.7 | Comparative example steel |

*The underlined values are outside the scope of the present invention.

TABLE 2

| No. | Steel No. | Annealing conditions HR1 (° C./s) *1 | HR2 (° C./s) *2 | Annealing temperature (° C.) | Dew-point temperature (° C.) | Soaking time (s) | CR1 (° C./s) *3 | CR2 (° C./s) *4 | Holding time (sec) *5 | CR3 (° C./s) *6 | CR4 (° C./s) *7 | Cooling stop temperature (° C.) | Retention time (sec) *8 | Heating rate (° C./s) *9 | Holding temperature (° C.) | Holding time (sec) *10 | Coating type *11 | Note |
|---|---|---|---|---|---|---|---|---|---|---|---|---|---|---|---|---|---|---|
| 1 | A | 2 | 2 | 805 | −40 | 180 | 5 | 20 | 35 | 12 | 8 | 200 | 12 | 15 | 400 | 800 | CR | Example |
| 2 | A | 10 | 2 | 805 | −40 | 180 | 5 | 20 | 35 | 12 | 8 | 200 | 12 | 15 | 400 | 800 | CR | Comparative Example |
| 3 | A | 2 | 10 | 805 | −40 | 180 | 5 | 20 | 35 | 12 | 8 | 200 | 12 | 15 | 400 | 800 | CR | Comparative Example |
| 4 | A | 2 | 2 | 760 | −40 | 180 | 5 | 20 | 35 | 12 | 8 | 200 | 12 | 15 | 400 | 800 | CR | Comparative Example |
| 5 | A | 2 | 2 | 860 | −40 | 180 | 5 | 20 | 35 | 12 | 8 | 200 | 12 | 15 | 400 | 800 | CR | Comparative Example |
| 6 | A | 2 | 2 | 805 | −40 | 180 | 0.2 | 20 | 35 | 12 | 8 | 200 | 12 | 15 | 400 | 800 | CR | Comparative Example |
| 7 | A | 2 | 2 | 805 | −40 | 180 | 5 | 2 | 35 | 12 | 8 | 200 | 12 | 15 | 400 | 800 | CR | Comparative Example |
| 8 | A | 2 | 2 | 805 | −40 | 180 | 5 | 20 | 4 | 12 | 8 | 200 | 12 | 15 | 400 | 800 | CR | Comparative Example |
| 9 | A | 2 | 2 | 805 | −40 | 180 | 5 | 20 | 7 | 12 | 8 | 200 | 12 | 15 | 400 | 800 | CR | Comparative Example |
| 10 | A | 4 | 2 | 805 | −40 | 180 | 5 | 20 | 13 | 12 | 8 | 200 | 12 | 15 | 400 | 800 | CR | Example |

TABLE 2-continued

| No. | Steel No. | Annealing conditions HR1 (° C./s) *1 | HR2 (° C./s) *2 | Annealing temperature (° C.) | Dew-point temperature (° C.) | Soaking time (s) | CR1 (° C./s) *3 | CR2 (° C./s) *4 | Holding time (sec) *5 | CR3 (° C./s) *6 | CR4 (° C./s) *7 | Cooling stop temperature (° C.) | Retention time (sec) *8 | Heating rate (° C./s) *9 | Holding temperature (° C.) | Holding time (sec) *10 | Coating type *11 | Note |
|---|---|---|---|---|---|---|---|---|---|---|---|---|---|---|---|---|---|---|
| 11 | A | 4 | 2 | 805 | −35 | 180 | 5 | 20 | 15 | 12 | 8 | 200 | 12 | 15 | 400 | 800 | CR | Example |
| 12 | A | 2 | 4 | 805 | −30 | 180 | 5 | 20 | 20 | 12 | 8 | 200 | 12 | 15 | 400 | 800 | CR | Example |
| 13 | A | 6 | 5 | 805 | −40 | 180 | 5 | 20 | 60 | 12 | 8 | 200 | 12 | 15 | 365 | 1200 | CR | Example |
| 14 | A | 2 | 2 | 805 | −40 | 180 | 5 | 20 | 600 | 12 | 8 | 200 | 12 | 15 | 400 | 800 | CR | Comparative Example |
| 15 | A | 2 | 2 | 805 | −40 | 180 | 5 | 20 | 35 | 0.4 | 8 | 200 | 12 | 15 | 400 | 800 | CR | Comparative Example |
| 16 | A | 2 | 2 | 805 | −40 | 180 | 5 | 20 | 35 | 12 | 20 | 200 | 12 | 15 | 400 | 800 | CR | Example |
| 17 | A | 2 | 2 | 805 | −40 | 180 | 5 | 20 | 35 | 12 | 8 | 150 | 12 | 15 | 400 | 800 | CR | Comparative Example |
| 18 | A | 3 | 3 | 805 | −40 | 180 | 5 | 20 | 35 | 8 | 1 | 220 | 12 | 15 | 400 | 800 | CR | Example |
| 19 | A | 2 | 2 | 805 | −40 | 180 | 5 | 20 | 35 | 12 | 10 | 200 | 60 | 15 | 400 | 800 | CR | Comparative Example |
| 20 | A | 2 | 2 | 805 | −40 | 180 | 5 | 20 | 35 | 12 | 10 | 200 | 62 | 1 | 400 | 800 | CR | Comparative Example |
| 21 | A | 2 | 2 | 805 | −40 | 180 | 5 | 20 | 35 | 12 | 8 | 200 | 12 | 15 | 320 | 180 | CR | Comparative Example |
| 22 | A | 2 | 2 | 805 | −40 | 180 | 5 | 20 | 35 | 12 | 8 | 200 | 12 | 15 | 400 | 15 | CR | Comparative Example |
| 23 | A | 6 | 2 | 805 | −40 | 180 | 5 | 20 | 35 | 12 | 8 | 200 | 12 | 15 | 400 | 60 | CR | Example |
| 24 | A | 2 | 2 | 805 | −40 | 180 | 5 | 20 | 35 | 12 | 8 | 200 | 12 | 15 | 400 | 180 | CR | Example |
| 25 | B | 2 | 2 | 790 | −40 | 180 | 5 | 20 | 35 | 12 | 8 | 200 | 12 | 15 | 400 | 800 | CR | Comparative Example |
| 26 | C | 2 | 2 | 845 | −40 | 180 | 5 | 20 | 35 | 12 | 8 | 175 | 12 | 15 | 400 | 800 | CR | Example |
| 27 | D | 2 | 2 | 840 | −40 | 180 | 5 | 20 | 35 | 12 | 8 | 250 | 12 | 15 | 360 | 800 | CR | Comparative Example |
| 28 | E | 2 | 2 | 780 | −40 | 180 | 5 | 20 | 35 | 12 | 8 | 220 | 12 | 15 | 480 | 2800 | CR | Comparative Example |
| 29 | F | 2 | 2 | 785 | −40 | 180 | 5 | 20 | 35 | 12 | 8 | 210 | 45 | 15 | 400 | 800 | CR | Example |
| 30 | G | 2 | 2 | 800 | −40 | 180 | 5 | 20 | 35 | 12 | 8 | 265 | 12 | 15 | 400 | 800 | CR | Comparative Example |
| 31 | H | 2 | 2 | 805 | −40 | 180 | 5 | 20 | 35 | 12 | 8 | 230 | 12 | 15 | 400 | 800 | CR | Comparative Example |
| 32 | I | 2 | 2 | 780 | −40 | 180 | 100 | 100 | 15 | 45 | 15 | 265 | 5 | 15 | 400 | 800 | CR | Example |
| 33 | J | 2 | 2 | 805 | −40 | 180 | 5 | 20 | 35 | 12 | 8 | 230 | 12 | 15 | 480 | 800 | GA | Example |

TABLE 2-continued

| No. | Steel No. | Annealing conditions: HR1 (° C./s) *1 | HR2 (° C./s) *2 | Annealing temperature (° C.) | Dew-point temperature (° C.) | Soaking time (s) | CR1 (° C./s) *3 | CR2 (° C./s) *4 | Holding time (sec) *5 | CR3 (° C./s) *6 | CR4 (° C./s) *7 | Cooling stop temperature (° C.) | Retention time (sec) *8 | Heating rate (° C./s) *9 | Holding temperature (° C.) | Holding time (sec) *10 | Coating type *11 | Note |
|---|---|---|---|---|---|---|---|---|---|---|---|---|---|---|---|---|---|---|
| 34 | K | 2 | 2 | 805 | −40 | 180 | 5 | 20 | 35 | 45 | 8 | 200 | 12 | 15 | 400 | 800 | CR | Comparative Example |
| 35 | L | 2 | 2 | 805 | −40 | 180 | 5 | 20 | 180 | 12 | 8 | 265 | 12 | 15 | 400 | 800 | CR | Comparative Example |
| 36 | M | 2 | 2 | 800 | −40 | 180 | 5 | 10 | 180 | 3 | 0.5 | 180 | 12 | 15 | 400 | 2800 | GI | Example |
| 37 | N | 2 | 2 | 805 | −40 | 180 | 5 | 20 | 35 | 12 | 8 | 220 | 12 | 15 | 400 | 800 | EG | Example |
| 38 | O | 2 | 2 | 845 | −40 | 180 | 5 | 20 | 35 | 12 | 8 | 265 | 12 | 15 | 400 | 800 | CR | Comparative Example |
| 39 | I | 2 | 2 | 760 | −40 | 180 | 5 | 20 | 35 | 55 | 18 | 260 | 2 | 15 | 400 | 800 | CR | Comparative Example |
| 40 | I | 2 | 2 | 760 | −40 | 180 | 5 | 20 | 35 | 12 | 8 | 280 | 12 | 15 | 400 | 800 | CR | Comparative Example |
| 41 | M | 2 | 2 | 800 | −40 | 180 | 5 | 20 | 35 | 12 | 8 | 220 | 12 | 15 | 510 | 2800 | CR | Comparative Example |
| 42 | M | 2 | 2 | 800 | −40 | 180 | 5 | 20 | 35 | 12 | 8 | 220 | 12 | 15 | 480 | 3200 | CR | Comparative Example |

*The underlined values are outside the scope of the present invention.
*1: Heating rate in the temperature range of 660° C. to 740° C.
*2: Heating rate in the temperature range of 740° C. to 770° C.
*3: Average cooling rate in the temperature range of 770° C. to 700° C.
*4: Average cooling rate in the temperature range of 700° C. to 500° C.
*5: Holding time in the temperature range of 500° C. to 405° C.
*6: Average cooling rate in the temperature range of 405° C. to cooling stop temperature Tsq
*7: Average cooling rate in the temperature range of 320° C. to 270° C.
*8: Retention time in the temperature range of 170° C. to 250° C. between cooling after annealing and heating
*9: Average heating rate in the temperature range of cooling stop temperature Tsq to 350° C.
*10: Holding time in the temperature range of 350° C. to 500° C.
*11: CR: cold-rolled steel sheet (without coating treatment), GA: galvannealed steel sheet, GI: hot-dip galvanized steel sheet (without alloying treatment of zinc), EG: electrogalvanized steel sheet

TABLE 3

| No. | Steel No. | Microstructure: Ferrite area ratio (%) | Remainder*12 area ratio (%) | Retained γ volume fraction (%) | $(S_{UB}/S_{2nd}) \times 100$ (%) | $N_\theta$ (/μm²) | $N_{Fine}$ (/μm²) | $S\gamma_{Block}$ (%) | Characteristics: TS (MPa) | EI (%) | TS × EI (MPa %) | Fracture under laser welding condition A | Fracture under laser welding condition B | Note |
|---|---|---|---|---|---|---|---|---|---|---|---|---|---|---|
| 1 | A | 10 | 90 | 11 | 3.5 | 0.3 | 0.08 | 1 | 1233 | 18.6 | 22934 | O | O | Example |
| 2 | A | 8 | 92 | 8 | 0.6 | 0.3 | 0.05 | 8 | 1268 | 12.6 | 15977 | NG | NG | Comparative Example |
| 3 | A | 8 | 92 | 8 | 0.6 | 0.3 | 0.05 | 8 | 1270 | 12.5 | 15875 | NG | NG | Comparative Example |
| 4 | A | 10 | 90 | 4 | 0.4 | 0.1 | 0.08 | 8 | 1268 | 12.2 | 15470 | NG | NG | Comparative Example |
| 5 | A | 1 | 99 | 2 | 4.0 | 0.1 | 0.08 | 0 | 1263 | 12.5 | 15788 | NG | NG | Comparative Example |
| 6 | A | 15 | 85 | 6 | 0.8 | 0.2 | 0.07 | 6 | 1170 | 15.0 | 17550 | NG | NG | Comparative Example |
| 7 | A | 10 | 90 | 8 | 0.7 | 0.1 | 0.08 | 6 | 1175 | 16.0 | 18800 | NG | NG | Comparative Example |
| 8 | A | 10 | 90 | 9 | 0.2 | 0.2 | 0.14 | 0 | 1251 | 13.4 | 16763 | NG | NG | Comparative Example |

TABLE 3-continued

| | | Microstructure | | | | | | | Characteristics | | | | | |
|---|---|---|---|---|---|---|---|---|---|---|---|---|---|---|
| No. | Steel No. | Ferrite area ratio (%) | Remainder*12 area ratio (%) | Retained γ volume fraction (%) | $(S_{UB}/S_{2nd}) \times 100$ (%) | $N_\theta$ (/μm²) | $N_{Fine}$ (/μm²) | $S\gamma_{Block}$ (%) | TS (MPa) | EI (%) | TS × EI (MPa %) | Fracture under laser welding condition A | Fracture under laser welding condition B | Note |
| 9 | A | 10 | 90 | 9 | 0.8 | 0.2 | 0.13 | 0 | 1249 | 13.3 | 16612 | NG | NG | Comparative Example |
| 10 | A | 10 | 90 | 10 | 2.0 | 0.2 | 0.12 | 1 | 1242 | 14.0 | 17388 | O | NG | Example |
| 11 | A | 10 | 90 | 11 | 3.0 | 0.2 | 0.10 | 1 | 1238 | 15.4 | 19065 | O | O | Example |
| 12 | A | 10 | 90 | 12 | 4.0 | 0.2 | 0.09 | 2 | 1235 | 16.4 | 20254 | O | O | Example |
| 13 | A | 10 | 90 | 10 | 2.2 | 0.2 | 0.09 | 3 | 1224 | 15.7 | 19217 | O | NG | Example |
| 14 | A | 9 | 91 | 10 | 3.0 | 0.2 | 0.09 | 6 | 1218 | 17.7 | 21559 | NG | NG | Comparative Example |
| 15 | A | 10 | 90 | 12 | 3.0 | 8.0 | 0.24 | 6 | 1214 | 16.2 | 19667 | NG | NG | Comparative Example |
| 16 | A | 10 | 90 | 8 | 3.0 | 5.0 | 0.00 | 3 | 1249 | 14.2 | 17736 | O | NG | Example |
| 17 | A | 9 | 91 | 2 | 2.0 | 8.0 | 0.12 | 0 | 1258 | 12.2 | 15348 | NG | NG | Comparative Example |
| 18 | A | 10 | 90 | 13 | 2.8 | 0.0 | 0.08 | 0 | 1200 | 19.1 | 22920 | O | O | Example |
| 19 | A | 10 | 90 | 6 | 3.1 | 8.0 | 0.08 | 0 | 1250 | 13.5 | 16875 | NG | NG | Comparative Example |
| 20 | A | 10 | 90 | 6 | 3.0 | 10.0 | 0.08 | 0 | 1255 | 13.5 | 16943 | NG | NG | Comparative Example |
| 21 | A | 10 | 90 | 2 | 2.7 | 8.0 | 0.22 | 0 | 1245 | 13.1 | 16310 | NG | NG | Comparative Example |
| 22 | A | 9 | 91 | 2 | 2.8 | 0.3 | 0.08 | 3 | 1244 | 13.2 | 16421 | NG | NG | Comparative Example |
| 23 | A | 10 | 90 | 4 | 2.9 | 0.3 | 0.08 | 1 | 1238 | 14.3 | 17703 | O | NG | Example |
| 24 | A | 10 | 90 | 7 | 3.0 | 0.2 | 0.08 | 1 | 1236 | 15.5 | 19158 | O | NG | Example |
| 25 | B | 10 | 90 | 2 | 1.6 | 2.4 | 0.08 | 1 | 1170 | 13.2 | 15444 | NG | NG | Comparative Example |
| 26 | C | 43 | 57 | 8 | 3.5 | 0.2 | 0.06 | 0 | 1050 | 19.0 | 19950 | O | O | Example |
| 27 | D | 5 | 95 | 11 | 2.3 | 12.0 | 0.42 | 1 | 1621 | 8.5 | 13779 | NG | NG | Comparative Example |
| 28 | E | 91 | 9 | 1 | 18.0 | 2.0 | 0.01 | 2 | 542 | 22.7 | 12303 | NG | NG | Comparative Example |
| 29 | F | 55 | 45 | 6 | 8.0 | 0.2 | 0.05 | 1 | 812 | 25.0 | 20300 | O | O | Example |
| 30 | G | 11 | 89 | 21 | 3.3 | 0.1 | 0.15 | 12 | 1175 | 18.0 | 21150 | NG | NG | Comparative Example |
| 31 | H | 22 | 78 | 2 | 2.4 | 13.0 | 0.03 | 8 | 1201 | 12.4 | 14892 | NG | NG | Comparative Example |
| 32 | I | 6 | 94 | 14 | 3.2 | 7.7 | 0.37 | 2 | 1545 | 12.4 | 19158 | O | O | Example |
| 33 | J | 15 | 85 | 12 | 3.4 | 0.2 | 0.11 | 1 | 1225 | 18.4 | 22540 | O | O | Example |
| 34 | K | 8 | 92 | 9 | 1.7 | 2.0 | 0.08 | 0 | 1089 | 15.1 | 16444 | O | NG | Comparative Example |
| 35 | L | 32 | 68 | 2 | 17.4 | 9.2 | 0.05 | 12 | 1162 | 14.1 | 16384 | O | NG | Comparative Example |
| 36 | M | 67 | 33 | 10 | 8.5 | 0.7 | 0.08 | 2 | 641 | 28.0 | 17948 | O | NG | Example |
| 37 | N | 13 | 87 | 10 | 3.1 | 0.2 | 0.07 | 1 | 1245 | 17 8 | 22161 | O | O | Example |
| 38 | O | 0 | 100 | 11 | 2.2 | 3.0 | 0.15 | 24 | 1301 | 12.1 | 15742 | O | NG | Comparative Example |
| 39 | I | 12 | 88 | 4 | 2.8 | 8.8 | 0.02 | 8 | 1510 | 9.5 | 14345 | NG | NG | Comparative Example |
| 40 | I | 13 | 87 | 3 | 3.3 | 7.4 | 0.06 | 34 | 1599 | 6.6 | 10553 | O | NG | Comparative Example |
| 41 | M | 60 | 40 | 2 | 7.8 | 5.2 | 0.09 | 3 | 540 | 29.0 | 15660 | O | NG | Comparative Example |
| 42 | M | 65 | 35 | 2 | 8.1 | 5.4 | 1.12 | 2 | 562 | 27.8 | 15624 | O | NG | Comparative Example |

*The underlined values are outside the scope of the present invention.

O Base material fracture, NG Weld fracture

*12Microstructure composed of one or two or more of upper bainite, fresh martensite, tempered martensite, lower bainite, and retained γ

Example 2

A cold-rolled steel sheet 1.4 mm in thickness with a chemical composition listed in Table 1 was treated under the annealing conditions listed in Table 4 to produce steel sheets according to aspects of the present invention and comparative examples.

Galvanizing treatment or galvannealing treatment was performed between the cooling at an average cooling rate in the range of 8° C./s to 2000° C./s in the temperature range of 700° C. to 500° C. and the holding in the temperature range of 500° C. to 405° C. for 13 to 200 seconds. More specifically, a steel sheet was immersed in a galvanizing bath in the temperature range of 440° C. to 500° C. for hot-dip galvanizing treatment. Subsequently, the amount of coating was adjusted by gas wiping or the like. The hot-dip galvanizing was performed in a galvanizing bath with an Al content in the range of 0.10% to 0.22%. After the hot-dip galvanizing treatment, part of the hot-dip galvanized steel sheets were subjected to alloying treatment to form galvannealed steel sheets (GA). The alloying treatment of zinc coating was performed in the temperature range of 460° C. to 580° C.

The determination of the steel microstructure, the tensile test, and the evaluation of the HAZ softening resistance of the steel were performed in the same manner as in Example 1. Table 5 shows the results.

In the working examples, TS×El≥17000 MPa·% is satisfied, and the laser-welded portion can also have base material fracture.

The working example No. 3 has $(S_{UB}/S_{2nd})\times100(\%)$ of 3.0 or more, $N_\theta$ of 5/μm² or less, $N_{Fine}$ of 0.03/μm² or more, and $S_{\gamma Block}$ of 5% or less, has base material fracture even under the condition B including a gap in butt welding, has ductility satisfying TS×El≥19000 MPa·%, and is therefore particularly good.

TABLE 4

| No. | Steel No. | Annealing conditions: HR1 (° C./s) *1 | HR2 (° C./s) *2 | Annealing temperature (° C.) | Dew-point temperature (° C.) | Soaking time (s) | CR1 (° C./s) *3 | CR2 (° C./s) *4 | Coating temperature | Alloying treatment temperature | Holding time (sec) *5 | CR3 (° C./s) *6 | CR4 (° C./s) *7 | Cooling stop temperature (° C.) | Retention time (sec) *8 | Heating rate (° C./s) *9 | Holding temperature (° C.) | Holding time (sec) *10 | Coating *11 | Note |
|---|---|---|---|---|---|---|---|---|---|---|---|---|---|---|---|---|---|---|---|---|
| 1 | A | 2 | 2 | 805 | −40 | 180 | 5 | 20 | 460 | — | 15 | 10 | 7 | 240 | 12 | 15 | 400 | 400 | GI | Example |
| 2 | C | 2 | 2 | 805 | −40 | 180 | 5 | 20 | 460 | 560 | 15 | 12 | 8 | 230 | 10 | 15 | 400 | 800 | GA | Example |
| 3 | C | 2 | 2 | 805 | −25 | 180 | 5 | 20 | 460 | 560 | 35 | 12 | 7 | 230 | 5 | 20 | 400 | 800 | GA | Example |
| 4 | A | 2 | 2 | 805 | −43 | 180 | 5 | 20 | 460 | 570 | 250 | 12 | 8 | 230 | 10 | 15 | 400 | 800 | GA | Comparative Example |

*The underlined values are outside the scope of the present invention.

*1: Heating rate in the temperature range of 660° C. to 740° C.

*2: Heating rate in the temperature range of 740° C. to 770° C.

*3: Average cooling rate in the temperature range of 770° C. to 700° C.

*4: Average cooling rate in the temperature range of 700° C. to 500° C.

*5: Holding time in the temperature range of 500° C. to 405° C.

*6: Average cooling rate in the temperature range of 405° C. to cooling stop temperature Tsq

*7: Average cooling rate in the temperature range of 320° C. to 270° C.

*8: Retention time in the temperature range of 170° C. to 250° C. between cooling after annealing and heating

*9: Average heating rate in the temperature range of cooling stop temperature Tsq to 350° C.

*10: Holding time in the temperature range of 350° C. to 500° C.

*11: CR: cold-rolled steel sheet (without coating treatment), GA: galvannealed steel sheet, GI: hot-dip galvanized steel sheet (without alloying treatment of zinc coating), EG: electrogalvanized steel sheet

TABLE 5

| No. | Steel No. | Microstructure: Ferrite area ratio (%) | Remainder*12 area ratio (%) | Retained γ volume fraction (%) | $(S_{UB}/S_{2nd}) \times 100$ (%) | $N_\theta$ (/μm$^2$) | $N_{Fine}$ (/μm$^2$) | $S\gamma_{Block}$ (%) | Characteristics: TS (MPa) | EI (%) | TS × EI (MPa %) | Fracture under laser welding condition A | Fracture under laser welding condition B | Note |
|---|---|---|---|---|---|---|---|---|---|---|---|---|---|---|
| 1 | A | 9 | 91 | 10 | 2.2 | 0.3 | 0.05 | 3 | 1222 | 16.7 | 20407.4 | O | NG | Example |
| 2 | C | 35 | 65 | 8 | 2.8 | 0.2 | 0.06 | 2 | 1046 | 17.8 | 18618.8 | O | NG | Example |
| 3 | C | 41 | 59 | 12 | 3.4 | 0.2 | 0.06 | 1 | 1040 | 19.1 | 19864 | O | O | Example |
| 4 | A | 12 | 88 | 7 | 8.7 | 0.4 | 0.08 | 9 | 1202 | 15.5 | 18631 | NG | NG | Comparative Example |

*The underlined values are outside the scope of the present invention.

O Base material fracture, NG Weld fracture

*12Microstructure composed of one or two or more of upper bainite, fresh martensite, tempered martensite, lower bainite, and retained γ

INDUSTRIAL APPLICABILITY

Aspects of the present invention provide high ductility and high HAZ softening resistance and are suitably applicable to press forming used through a press forming process in automobiles, household electrical appliances, and the like.

The invention claimed is:

1. A steel sheet comprising, as a chemical composition, on a mass percent basis:

C: 0.06% to 0.25%,

Si: 0.1% to 2.5%,

Mn: 2.0% to 3.2%,

P: 0.02% or less,

S: 0.01% or less, sol. Al: less than 1.0% (including 0%), and

N: less than 0.015%, wherein a total content of Si and sol. Al: Si+sol. Al ranges from 0.7% to 2.5%, a remainder being Fe and incidental impurities, a steel microstructure contains ferrite: 6% to 90% by area, a microstructure composed of one or two or more of upper bainite, fresh martensite, tempered martensite, lower bainite, and retained γ: 10% to 94% by area in total, and retained γ: 3% to 20% by volume, a ratio $(S_{UB}/S_{2nd})\times100(\%)$ of an area ratio $S_{UB}$ of an upper bainite with a width in the range of 0.8 to 7 μm, a length in the range of 2 to 15 μm, and an aspect ratio of 2.2 or more in contact with retained $\gamma_{UB}$ with a grain width in the range of 0.17 to 0.80 μm and an aspect ratio in the range of 4 to 25 to an area ratio $S_{2nd}$ of the microstructure composed of one or two or more of upper bainite, fresh martensite, tempered martensite, lower bainite, and retained γ ranges from 2.0% to 15%, grains with an aspect ratio of 3.5 or less and an equivalent circular diameter in the range of 0.02 to 0.25 μm in the microstructure composed of one or two or more of upper bainite, fresh martensite, tempered martensite, lower bainite, and retained γ have a distribution density $N_\theta$ of 7/μm$^2$ or less (including 0/μm$^2$), and grains with an equivalent circular diameter in the range of 1.3 to 20 μm and an aspect ratio of 3 or less have a total area ratio $S_{\gamma Block}$ of 5% or less (including 0%).

2. The steel sheet according to claim 1, wherein grains with an aspect ratio in the range of 3.6 to 15 and a grain width in the range of 0.14 to 0.30 μm in the microstructure composed of one or two or more of upper bainite, fresh martensite, tempered martensite, lower bainite, and retained γ have a distribution density $N_{Fine}$ in the range of 0.03 to 0.4/μm$^2$.

3. The steel sheet according to claim 1, wherein the chemical composition further comprises, on a mass percent basis, at least one of selected from groups A, B and C:

Group A: one or two selected from
Ti: 0.002% to 0.1% and B: 0.0002% to 0.01%,
group B: one or two or more selected from
Cu: 0.005% to 1%,
Ni: 0.01% to 1%,
Cr: 0.01% to 1.0%,
Mo: 0.01% to 0.5%,
V: 0.003% to 0.5%,
Nb: 0.002% to 0.1%,
Zr: 0.005% to 0.2%, and
W: 0.005% to 0.2%,
group C: one or two or more selected from
Ca: 0.0002% to 0.0040%,
Ce: 0.0002% to 0.0040%,
La: 0.0002% to 0.0040%,
Mg: 0.0002% to 0.0030%,
Sb: 0.002% to 0.1%, and
Sn: 0.002% to 0.1%.

4. The steel sheet according to claim 2, wherein the chemical composition further comprises, on a mass percent basis, at least one of selected from groups A, B and C:

Group A: one or two selected from
Ti: 0.002% to 0.1% and B: 0.0002% to 0.01%,
group B: one or two or more selected from
Cu: 0.005% to 1%,
Ni: 0.01% to 1%,
Cr: 0.01% to 1.0%,
Mo: 0.01% to 0.5%,
V: 0.003% to 0.5%,
Nb: 0.002% to 0.1%,
Zr: 0.005% to 0.2%, and
W: 0.005% to 0.2%,
group C: one or two or more selected from
Ca: 0.0002% to 0.0040%,
Ce: 0.0002% to 0.0040%,
La: 0.0002% to 0.0040%,
Mg: 0.0002% to 0.0030%,
Sb: 0.002% to 0.1%, and
Sn: 0.002% to 0.1%.

5. The steel sheet according to claim 1, comprising a galvanized layer on a surface of the steel sheet.

6. The steel sheet according to claim 2, comprising a galvanized layer on a surface of the steel sheet.

7. The steel sheet according to claim 3, comprising a galvanized layer on a surface of the steel sheet.

8. The steel sheet according to claim 4, comprising a galvanized layer on a surface of the steel sheet.

9. A method for producing the steel sheet according to claim 1 comprising: hot-rolling and cold-rolling a steel slab with the chemical composition according to claim 1, then in a continuous annealing line, heating the cold-rolled steel sheet at 1° C./s to 6° C./s in the temperature range of 660° C. to 740° C., heating the cold-rolled steel sheet at 1° C./s to 6° C./s in the temperature range of 740° C. to 770° C., annealing the cold-rolled steel sheet in an annealing temperature range of 770° C. to 850° C., then cooling the cold-rolled steel sheet at an average cooling rate in the range of 1° C./s to 2000° C./s in the temperature range of 770° C. to 700° C., further cooling the cold-rolled steel sheet at an average cooling rate in the range of 8° C./s to 2000° C./s in the temperature range of 700° C. to 500° C., then holding the cold-rolled steel sheet in the temperature range of 500° C. to 405° C. for 13 to 200 seconds, then cooling the cold-rolled steel sheet from 405° C. to a cooling stop temperature Tsq in the range of 170° C. to 270° C. at an average cooling rate in the range of 1° C./s to 50° C./s, then heating the cold-rolled steel sheet in the temperature range of the cooling stop temperature Tsq to 350° C. at an average heating rate of 2° C./s or more, holding the cold-rolled steel sheet at 350° C. to 500° C. for 20 to 3000 seconds, and then cooling the cold-rolled steel sheet to room temperature, wherein a retention time in the temperature range of 170° C. to 250° C. between the cooling after the annealing and the heating at an average heating rate of 2° C./s or more is 50 seconds or less.

10. A method for producing the steel sheet according to claim 2 comprising: hot-rolling and cold-rolling a steel slab with the chemical composition according to claim 2, then in a continuous annealing line, heating the cold-rolled steel sheet at 1° C./s to 6° C./s in the temperature range of 660° C. to 740° C., heating the cold-rolled steel sheet at 1° C./s to 6° C./s in the temperature range of 740° C. to 770° C., annealing the cold-rolled steel sheet in an annealing temperature range of 770° C. to 850° C., then cooling the cold-rolled steel sheet at an average cooling rate in the range of 1° C./s to 2000° C./s in the temperature range of 770° C. to 700° C., further cooling the cold-rolled steel sheet at an average cooling rate in the range of 8° C./s to 2000° C./s in the temperature range of 700° C. to 500° C., then holding the cold-rolled steel sheet in the temperature range of 500° C. to 405° C. for 13 to 200 seconds, then cooling the cold-rolled steel sheet from 405° C. to a cooling stop temperature Tsq in the range of 170° C. to 270° C. at an average cooling rate in the range of 1° C./s to 50° C./s, then heating the cold-rolled steel sheet in the temperature range of the cooling stop temperature Tsq to 350° C. at an average heating rate of 2° C./s or more, holding the cold-rolled steel sheet at 350° C. to 500° C. for 20 to 3000 seconds, and then cooling the cold-rolled steel sheet to room temperature, wherein a retention time in the temperature range of 170° C. to 250° C. between the cooling after the annealing and the heating at an average heating rate of 2° C./s or more is 50 seconds or less.

11. A method for producing the steel sheet according to claim 3 comprising: hot-rolling and cold-rolling a steel slab with the chemical composition according to claim 3, then in a continuous annealing line, heating the cold-rolled steel sheet at 1° C./s to 6° C./s in the temperature range of 660° C. to 740° C., heating the cold-rolled steel sheet at 1° C./s to 6° C./s in the temperature range of 740° C. to 770° C., annealing the cold-rolled steel sheet in an annealing temperature range of 770° C. to 850° C., then cooling the cold-rolled steel sheet at an average cooling rate in the range of 1° C./s to 2000° C./s in the temperature range of 770° C. to 700° C., further cooling the cold-rolled steel sheet at an average cooling rate in the range of 8° C./s to 2000° C./s in the temperature range of 700° C. to 500° C., then holding the cold-rolled steel sheet in the temperature range of 500° C. to 405° C. for 13 to 200 seconds, then cooling the cold-rolled steel sheet from 405° C. to a cooling stop temperature Tsq in the range of 170° C. to 270° C. at an average cooling rate in the range of 1° C./s to 50° C./s, then heating the cold-rolled steel sheet in the temperature range of the cooling stop temperature Tsq to 350° C. at an average heating rate of 2° C./s or more, holding the cold-rolled steel sheet at 350° C. to 500° C. for 20 to 3000 seconds, and then cooling the cold-rolled steel sheet to room temperature, wherein a retention time in the temperature range of 170° C. to 250° C. between the cooling after the annealing and the heating at an average heating rate of 2° C./s or more is 50 seconds or less.

12. A method for producing the steel sheet according to claim 4 comprising: hot-rolling and cold-rolling a steel slab with the chemical composition according to claim 4, then in a continuous annealing line, heating the cold-rolled steel sheet at 1° C./s to 6° C./s in the temperature range of 660° C. to 740° C., heating the cold-rolled steel sheet at 1° C./s to 6° C./s in the temperature range of 740° C. to 770° C., annealing the cold-rolled steel sheet in an annealing temperature range of 770° C. to 850° C., then cooling the cold-rolled steel sheet at an average cooling rate in the range of 1° C./s to 2000° C./s in the temperature range of 770° C. to 700° C., further cooling the cold-rolled steel sheet at an average cooling rate in the range of 8° C./s to 2000° C./s in the temperature range of 700° C. to 500° C., then holding the cold-rolled steel sheet in the temperature range of 500° C. to 405° C. for 13 to 200 seconds, then cooling the cold-rolled steel sheet from 405° C. to a cooling stop temperature Tsq in the range of 170° C. to 270° C. at an average cooling rate in the range of 1° C./s to 50° C./s, then heating the cold-rolled steel sheet in the temperature range of the cooling stop temperature Tsq to 350° C. at an average heating rate of 2° C./s or more, holding the cold-rolled steel sheet at 350° C. to 500° C. for 20 to 3000 seconds, and then cooling the cold-rolled steel sheet to room temperature, wherein a retention time in the temperature range of 170° C. to 250° C. between the cooling after the annealing and the heating at an average heating rate of 2° C./s or more is 50 seconds or less.

13. The method according to claim 9, wherein a dew-point temperature in the annealing in an annealing temperature range of 770° C. to 850° C. is −45° C. or more.

14. The method according to claim 10, wherein a dew-point temperature in the annealing in an annealing temperature range of 770° C. to 850° C. is −45° C. or more.

15. The method according to claim 11, wherein a dew-point temperature in the annealing in an annealing temperature range of 770° C. to 850° C. is −45° C. or more.

16. The method according to claim 12, wherein a dew-point temperature in the annealing in an annealing temperature range of 770° C. to 850° C. is −45° C. or more.

17. The method sheet according to claim 9, wherein galvanizing treatment or galvannealing treatment is performed between the cooling at an average cooling rate in the range of 8° C./s to 2000° C./s in the temperature range of 700° C. to 500° C. and the holding in the temperature range of 500° C. to 405° C. for 13 to 200 seconds.

18. The method according to claim 10, wherein galvanizing treatment or galvannealing treatment is performed between the cooling at an average cooling rate in the range of 8° C./s to 2000° C./s in the temperature range of 700° C. to 500° C. and the holding in the temperature range of 500° C. to 405° C. for 13 to 200 seconds.

19. The method according to claim 11, wherein galvanizing treatment or galvannealing treatment is performed between the cooling at an average cooling rate in the range of 8° C./s to 2000° C./s in the temperature range of 700° C. to 500° C. and the holding in the temperature range of 500° C. to 405° C. for 13 to 200 seconds.

20. The method according to claim 12, wherein galvanizing treatment or galvannealing treatment is performed between the cooling at an average cooling rate in the range of 8° C./s to 2000° C./s in the temperature range of 700° C. to 500° C. and the holding in the temperature range of 500° C. to 405° C. for 13 to 200 seconds.

21. The method according to claim 9, wherein the holding at 350° C. to 500° C. for 20 to 3000 seconds is followed by galvanizing treatment or galvannealing treatment.

22. The method according to claim 10, wherein the holding at 350° C. to 500° C. for 20 to 3000 seconds is followed by galvanizing treatment or galvannealing treatment.

23. The method according to claim 11, wherein the holding at 350° C. to 500° C. for 20 to 3000 seconds is followed by galvanizing treatment or galvannealing treatment.

24. The method according to claim 12, wherein the holding at 350° C. to 500° C. for 20 to 3000 seconds is followed by galvanizing treatment or galvannealing treatment.

* * * * *